US009711341B2

(12) United States Patent
Ramsey et al.

(10) Patent No.: US 9,711,341 B2
(45) Date of Patent: Jul. 18, 2017

(54) MASS SPECTROMETRY SYSTEMS WITH CONVECTIVE FLOW OF BUFFER GAS FOR ENHANCED SIGNALS AND RELATED METHODS

(71) Applicant: The University of North Carolina at Chapel Hill, Chapel Hill, NC (US)

(72) Inventors: John Michael Ramsey, Chapel Hill, NC (US); Kevin Philip Schultze, Chapel Hill, NC (US); Bruno Jean-Bernard Coupier, Chapel Hill, NC (US)

(73) Assignee: The University of North Carolina at Chapel Hill, Chapel Hill, NC (US)

( * ) Notice: Subject to any disclaimer, the term of this patent is extended or adjusted under 35 U.S.C. 154(b) by 0 days.

(21) Appl. No.: 14/734,623

(22) Filed: Jun. 9, 2015

(65) Prior Publication Data

US 2015/0364315 A1 Dec. 17, 2015

Related U.S. Application Data

(60) Provisional application No. 62/010,050, filed on Jun. 10, 2014.

(51) Int. Cl.

| | |
|---|---|
| ***H01J 49/24*** | (2006.01) |
| ***H01J 49/42*** | (2006.01) |
| ***H01J 49/00*** | (2006.01) |

(52) U.S. Cl.

CPC ..... *H01J 49/24* (2013.01); *H01J 49/0022* (2013.01); *H01J 49/424* (2013.01)

(58) Field of Classification Search

CPC ..... H01J 49/0022; H01J 49/24; H01J 49/424

See application file for complete search history.

(56) References Cited

U.S. PATENT DOCUMENTS

| | | | | |
|---|---|---|---|---|
| 2,939,952 | A | 6/1960 | Paul et al. | |
| 5,051,582 | A | 9/1991 | Bahns et al. | |
| 5,115,131 | A * | 5/1992 | Jorgenson | H01J 49/165 250/282 |
| 5,118,950 | A | 6/1992 | Bahns et al. | |
| 5,206,506 | A | 4/1993 | Kirchner | |
| 5,248,883 | A | 9/1993 | Brewer et al. | |
| 5,596,193 | A | 1/1997 | Chutjian et al. | |
| 5,613,294 | A | 3/1997 | Ferran | |
| 5,793,091 | A | 8/1998 | Devoe | |
| 5,811,820 | A | 9/1998 | Kirchner et al. | |
| 5,859,433 | A * | 1/1999 | Franzen | H01J 49/0404 250/288 |
| 5,866,901 | A | 2/1999 | Penn et al. | |

(Continued)

OTHER PUBLICATIONS

Alberici et al., "Ambient mass spectrometry: bringing MS into the 'real world'", Anal. Bioanal. Chem. 398: 265-294 (2010).

(Continued)

*Primary Examiner* — Wyatt Stoffa

(74) *Attorney, Agent, or Firm* — Myers Bigel, P.A.

(57) ABSTRACT

Mass spectrometry systems include an ionizer, mass analyzer and the detector, with a high pressure chamber holding the mass analyzer and a separate chamber holding the detector to allow for differential background pressures where P2<P1 which generates gas flow through an unsealed, sealed or partially sealed ion trap and enhances detected signal relative to when P2=P1.

27 Claims, 26 Drawing Sheets

(56) References Cited

U.S. PATENT DOCUMENTS

| | | | | |
|---|---|---|---|---|
| 6,157,031 | A | 12/2000 | Prestage | |
| 6,452,326 | B1 | 9/2002 | Ge et al. | |
| 6,469,298 | B1 * | 10/2002 | Ramsey | H01J 49/0018 250/281 |
| 6,483,109 | B1 | 11/2002 | Reinhold et al. | |
| 6,521,898 | B2 | 2/2003 | Chutjian et al. | |
| 6,545,268 | B1 | 4/2003 | Verentchikov et al. | |
| 6,762,406 | B2 | 7/2004 | Cooks et al. | |
| 6,822,225 | B2 | 11/2004 | Xu et al. | |
| 6,838,666 | B2 | 1/2005 | Ouyang et al. | |
| 6,870,158 | B1 | 3/2005 | Blain | |
| 6,933,498 | B1 | 8/2005 | Whitten et al. | |
| 7,560,688 | B2 | 7/2009 | Clowers et al. | |
| 7,772,546 | B2 | 8/2010 | Jackson | |
| 7,973,277 | B2 | 7/2011 | Rafferty | |
| 8,101,908 | B2 | 1/2012 | Senko | |
| 8,878,127 | B2 | 11/2014 | Ramsey et al. | |
| 9,406,492 | B1 * | 8/2016 | Ramsey | B01L 3/5027 |
| 2002/0195559 | A1 | 12/2002 | Miseki | |
| 2003/0066958 | A1 * | 4/2003 | Okumura | H01J 49/401 250/286 |
| 2004/0079874 | A1 * | 4/2004 | Bateman | H01J 49/004 250/281 |
| 2004/0089799 | A1 * | 5/2004 | Kawato | H01J 49/005 250/281 |
| 2004/0135080 | A1 | 7/2004 | Ouyang et al. | |
| 2004/0164240 | A1 * | 8/2004 | Okumura | H01J 49/0045 250/288 |
| 2005/0061966 | A1 * | 3/2005 | Ding | H01J 49/424 250/288 |
| 2005/0196720 | A1 | 9/2005 | Ostler et al. | |
| 2006/0219888 | A1 | 10/2006 | Jachowski et al. | |
| 2007/0045533 | A1 * | 3/2007 | Krutchinsky | H01J 49/423 250/290 |
| 2007/0158543 | A1 | 7/2007 | Clowers et al. | |
| 2009/0294655 | A1 | 12/2009 | Ding et al. | |
| 2010/0084549 | A1 | 4/2010 | Ermakov et al. | |
| 2011/0147581 | A1 | 6/2011 | Chen et al. | |
| 2011/0248160 | A1 | 10/2011 | Belov | |
| 2012/0138790 | A1 * | 6/2012 | Wright | H01J 49/0013 250/288 |
| 2012/0256083 | A1 | 10/2012 | Kovtoun | |
| 2012/0267523 | A1 * | 10/2012 | Lammert | H01J 49/0013 250/283 |
| 2013/0015347 | A1 * | 1/2013 | Steiner | H01J 49/068 250/288 |
| 2013/0043382 | A1 * | 2/2013 | Berkout | H01J 49/24 250/282 |
| 2013/0240724 | A1 | 9/2013 | Guna | |
| 2014/0183355 | A1 * | 7/2014 | Bartfay-Szabo | H01J 49/24 250/290 |
| 2014/0209814 | A1 * | 7/2014 | Whitehouse | H01J 49/147 250/396 R |
| 2014/0263999 | A1 | 9/2014 | Ramsey et al. | |
| 2014/0264013 | A1 * | 9/2014 | Rafferty | H01J 49/147 250/288 |
| 2015/0008320 | A1 * | 1/2015 | Loboda | H01J 49/4255 250/288 |
| 2015/0034820 | A1 * | 2/2015 | Evans-Nguyen | H01J 49/0031 250/283 |

OTHER PUBLICATIONS

Albrieux et al. "Ion trajectory simulations in a high-pressure cylindrical ion trap", European J. Mas Spectrum. 16:357-565 (2010).
Allied Electronics, GC Electronics 10-8880 Product Detail, Chemical, High Voltage Putty, Printed from the internet: Jun. 10, 2014.
Amini et at. "Microfabricated Chip Traps for Ions", Atom Chips (2011).
Austin et al. Halo Ion Trap Mass Spectrometer, Anal. Chem. 79, 2927-2932 (2007).
Austin et al. "Simulations of Ion Trapping in a Micrometer-Sized Cylindrical Ion Trap", J.Am. Soc. Mass Spectrom. 17:30-441 (2006).
Badman et al. "A Miniature Cylindrical Quadrupole Ion Trap: Simulation and Experiment", Anal. Cham. 70: 4896-4901 (1998).
Badman et al. "A Parallel Miniature Cylindrical Ion Trap Array" Anal. Chem. 72, 3291-3297 (2000).
Badman et al. "Miniature mass analyzers" J. Mass Spectrum. 35: 659-671 (2000).
Blain et al. "Micro Mass Spectrometer on a Chip" Sandia Report SAND2005-6838 (2005).
Blain, "Towards the Hand-held Mass Spectrometer: Design Considerations, Simulation, and Fabrication of Micrometer-Scaled Cylindrical Ion Traps", International Journal of Mass Spectrometry, (2004).
Bonner et al. "The Cylindrical Ion Trap. Part 1. General Introduction" International Journal of Mass Spectrometry and Ion Physics, (1977).
Brewer et al. "Planar ion microtraps", Phys. Rev. A 46(11): R6781-R6784 (1992).
Chaudhary et al. "Fabrication and Testing of a Miniature Cylindrical Ion Trap Mass Spectrometer Constructed from Low Temperature Co-fired Ceramics" www.elesevier.com/locate/ijms (2006).
Chen et al. "A Micro Ionizer for Portable Mass Spectromerters using Double-gated Isolated Vertically Aligned Carbon Nanofiber Arrays" IEEE Trans. Electron Devices, 58(7): 2149-2158 (2011).
Cheung, Kerry, "Chip-Scale Quadrupole Mass Filters for a Micro-Gas Analyzer", Ph.D. Thesis, Massachusetts Institute of Technology, Jun. 2009.
Contreras et al. "Hand-Portable Gas Chromatograph—Toroidal Ion Trap Mass Spectrometer (GC-TMS) for Detection of Hazardous Compounds", J AM Soc Mass Spectrom (2008).
Coupier B. et al. "Development of a miniature ion trap mass spectrometer for applications requiring portability", Presented at 60$^{th}$ ASMS Conference on Mass Spectrometry and Allied Topics, Vancouver, Canada, May 24, 2012.
Coupier B. et al. "Study of the Impact of Gas Flow in a Microscale Ion Trap Operated at High Pressure" Presented at 62$^{nd}$ ASMS Conference on Mass Spectrometry and Allied Topics, Baltimore, Maryland, Jun. 17, 2014.
Cruz et al. "Design, microfabrication, and analysis of micrometer-sized cylindrical ion trap arrays" Rev. Sci. Instrum. 78: 015107 (2007).
Falconer et al. "High Pressure Ion Detection for Miniaturized Mass Spectrometers", Presentation at 58$^{th}$ ASMS Conference 2010, Salt Lake City, UT, May 23, 2010.
Ferran et al. "High-pressure effects in miniature arrays of quadrupole analyzers for residual gas analysis from 10-9 to 10-2 Torr", J. Vac. Sci. Technol. A 14(3) 1258-1265 (1996).
Fico et al. "Circular Arrays of Polymer-Based Miniature Rectilinear Ion Traps", www.rsc.org/analyst, 2009.
Gao et al. "Design and Characterization of a Multisource Hand-Held Tandem Mass Spectrometer", Anal. Chem 80(19): 7198-7205 (2008).
Gao et al. "Handheld Rectilinear Ion Trap Mass Spectrometer" Anal. Chem. 78:5994-6002 (2006).
Gao, Liang "Miniaturization of the Ion Trap Mass Spectrometer", Ph.D. Thesis, Purdue University, 2009.
Goeringer et al. "Theory of High-Resolution Mass Spectrometry Achieved via Resonance Ejection in the Quadrupole Ion Tray", Anal. Chem. 64: 1434-1439 (1992).
Hadjar et al. "High-efficiency cross-beam magnetic electron-impact source for improved miniature Mattauch-Herzog mass spectrometer performance", Rev. Sci. Instrum. 83: 064101 (2012).
Hager "A New Linear Ion Trap Mass Spectrometer", Rapid Commun. Mass Spectrom. 2002.
Harris et al. "Ambient Sampling/Ionization Mass Spectrometry: Applications and Current Trends" Anal. Chem. 83: 4508-4538 (2011).
Harris et al. "Transportable real-time single-particle ion trap mass spectrometer", Rev. Sci Instrum. 76:064102 (2005).
Hensinger et al. "T-juction ion trap array for two-dimensional ion shuttling, storage, and manipulation", Applied Physics Letters, 88, 034101 (2006).

(56) References Cited

OTHER PUBLICATIONS

Hood, Derrell L. "Development of a Novel Loeb-Eiber Mass Filter", M.S. Thesis, Ohio State University 2009.
Huang et al. "Direct analysis of melamine in complex matrices using a handheld mass spectrometer" Analyst 135: 705-711 (2010).
Keil et al. "Ambient Mass Spectrometry with a Handheld Mass Spectrometer at High Pressure", Anal. Chem. 79:7734-7739 (2007).
Knapman et al. "Considerations in experimental and theoretical collision cross-section measurements of small molecules using travelling wave ion mobility spectrometry-mass spectrometry", Intl. J. Mass Spectrom, 2010, 298, 17-23.
Knight, "The Development of a Micro-Faraday Array for Ion Detection", www.elsevier.com/locate/ijms (2002).
Kornienko et al. "Electron impact ionization in a microion trap mass spectrometer", Ref. Sci. Instrum. 70(10): 3907-3909 (1999).
Kornienko et al. "Micro Ion Trap Mass Spectrometry", Rapid Commun. Mass Spectrom. 13:50-53 (1999).
Kornienko, "Field-Emission Cold-Cathode El Source for a Microscale Ion Trap Mass Spectrometer", Anal. Chem. 2000, 72, 559-562.
Lammert et al. "Miniature Toroidal Radio Frequency Ion Trap Mass Analyzer", J Am Soc Mass Spectrum 2006.
Lammert, "Design, Optimization and Initial Performance of a Toroidal RF Ion Trap Mass Spectrometer", Int. Journal of Mass Spectrometry, 2001.
Lammert, et al. "Experimental Investigation into the Performance of Ion Traps Using Air Versus Helium as the Buffer Gas", Rapid Communication in Mass Spectrometry, 1996.
Li et al. "Ion Trap Array Mass Analyzer: Structure and Performance", Anal. Chem. 81:4840-4846 (2009).
March, Raymond E. "An Introduction to Quadrupole Ion Trap Mass Spectrometry", J. Mass Spectrom. 32:351-369 (1997).
March, Raymond E. "Quadrupole Ion Trap Mass Spectrometer", Encyclopedia of Analytical Chemistry, pp. 11848-11872 (2000).
Mass et al. "Miniature Monolithic Rectilinear Ion Trap Arrays by Stereolithiography on Printed Circuit Board", Journal of Microelectromechanical Systems, 2010.
Mass et al. RF Planar Ion Trap for Chemical Sensing: Electrical Engineering Dept., Purdue University, 2011.
Misharin et al. "Development and characterization of a field deployable ion trap mass spectrometer with atmospheric pressure interface" Anal. Chem. 84(22): 10105-10112 (2012).
Moxom et al. "Analysis of Volatile Organic Compounds in Air with a Micro Ion Trap Mass Analyzer", Anal. Chem. 75:3739-3743 (2003).
Moxom et al. "Double resonance ejection in a micro ion trap mass spectrometer" Rapid Commun. Mass Spectrom. 16:755-760 (2002).
Moxom et al. "Sample pressure effects in a micro ion trap mass spectrometer" Rapid Commun. Mass Spectrom. 18: 721-723 (2004).
Orient et al. "Miniature, high-resolution, quadrupole mass-spectrometer array", Rev. Sci. Instrum. 68: 1393-1397 (1997).
Ouyang et al. "Handheld Miniature Ion Trap Mass Spectrometers" Analytical Chemistry, 2009.
Ouyang et al. "Quadrupole Ion Traps and Trap Arrays: Geometry, Material, Scale, Performance" Eur. J. Mass Spectrom, 2007.
Ouyang et al. "Rectilinear Ion Trap: Concepts, Calculations, and Analytical Performance of a New Mass Analyzer" Anal. Chem. 76: 4595-4605 (2004).
Patterson et al. "Miniature Cylindrical Ion Trap Mass Spectrometer", Anal. Chem. Purdue University, 2002.
Pau et al. "Microfabricated Quadrupole Ion Trap for Mass Spectrometer Applications", Phys. Rev. Lett. 96: 120801 (2006).
Pau et al. "Planar Geometry for Trapping and Separating Ions and Charged Particles" Anal. Chem. 79:6857-6861, 2007.
Peng et al. "Coaxial Ion Trap Mass Spectrometer: Concentric Toroidal and Quadrupolar Trapping Regions" Analytical Chemistry, 2011.
Peng et al. "New Approaches to Miniaturizing Ion Trap Mass Analyzers", Trends Anal. Chem. 30(10): 1560-1567 (2011).
Ramsey Research Group, High Pressure Mass Spectrometry, Department of Chemistry, The University of North Carolina at Chapel Hill, Retrieved from the internet on May 28, 2014 at URL http://www.chem.unc.edu/people/faculty/ramsey/group/micro %20ion%20trap/High%20Pressure%20MS/High%20Pressure %20MS.html.
Ramsey Research Group, Microscale and High Pressure Mass Spectrometry, Department of Chemistry, The University of North Carolina at Chapel Hill, Retrieved from the internet on May 28, 2014 at URL http://www.chem.unc.edu/people/faculty/ramsey/group/micro_ms.html.
Schwartz et al. "A Two-Dimensional Quadrupole Ion Trap Mass Spectrometer", jschwartz@thermofinnigan.com 2002.
Shiea, Jentaie, "Ionization methods for miniature mass spectrometers" Presentations at PITTCON 202, Orlando, FL, Mar. 14, 2012.
Sokol et al. "Miniature mass spectrometer equipped with electrospray and desorption electrospray ionization for direct analysis of organics from solids and solutions" Int. J. Mass Spectrom. 306: 187-195 (2011).
Song et al. "Novel Linear Ion Trap Mass Analyzer Composed of Four Planar Electrodes" AM Soc Mass Spectrom, Purdue University, 2006.
Song, Qingyu "Development of Mass Spectrometers using Rectilinear Ion Trap Analyzers" Ph.D. Thesis, Purdue University, 2008.
Syms, R.R.A. "Advances in microfabricated mass spectrometers", Anal. Bioanal. Chem. 393: 427-429 (2009).
Taylor et al. "A Simplified Toroidal Ion Trap Mass Analyzer", International Journal of Mass Spectrometry, 2012.
Telrandhe, Mangesh "Fabrication and testing of a cylindrical ion trap microarray for tunable mass spectrometers" M.S. Thesis, University of South Florida, 2004.
Van Amerom et al. "Microfabrication of Cylindrical Ion Trap Mass Spectrometer Arrays for Handheld Chemical Analyzers" Chem. Eng. Comm. 195: 98-114 (2008).
Wells et al. "A Quadrupole Ion Trap with Cylindrical Geometry Operated in the Mass-Selective Instability Mode" Anal. Chem. 70(3): 438-444, (1998).
Whitten et al. "High-pressure ion trap mass spectrometry", Rapid Commu. Mass Spectrom. 18: 1749-1752 (2004).
Whitten et al. "Miniature Ion Traps and Arrays for High Pressure Mass Spectrometry", HEMS Workshop 2005.
Wolfe D. et al. "High-Pressure Mass Spectrometry in Microscale Cylindrical Ion Traps", Presented at $60^{th}$ ASMS Conference on Mass Spectrometry and Allied Topics, Vancouver, Canada, May 24, 2012.
Wolfe et al. "RF amplifier optimization for improved resolution in microscale cylindrical ion traps" Presentation at $59^{th}$ ASMS Conference 2011, Denver, CO, Jun. 5, 2011.
Xu et al. "Ion Trap Mass Analysis at High Pressure: A Theoretical View", J. Am. Soc. Mass Spectrom, 20:2144-2153 (2009).
Xu et al. "Nondestructive Ion Trap Mass Analysis at High Pressure" Anal. Chem. 83(3):685-689 (2011).
Yang et al. "Development of a Palm Portable Mass Spectrometer" J. Am. Soc Mass Spectrom 2008.
Zhang et al. "Paul Trap Mass Analyzer Consisting of Opposing Microfabricated Electrode Pairs" Anal. Chem. 81: 5241-5248 (2009).
908 Devices, 908 Devices Introduces World's First Handheld Mass Spectrometer, Published: Mar. 10, 2014.

* cited by examiner

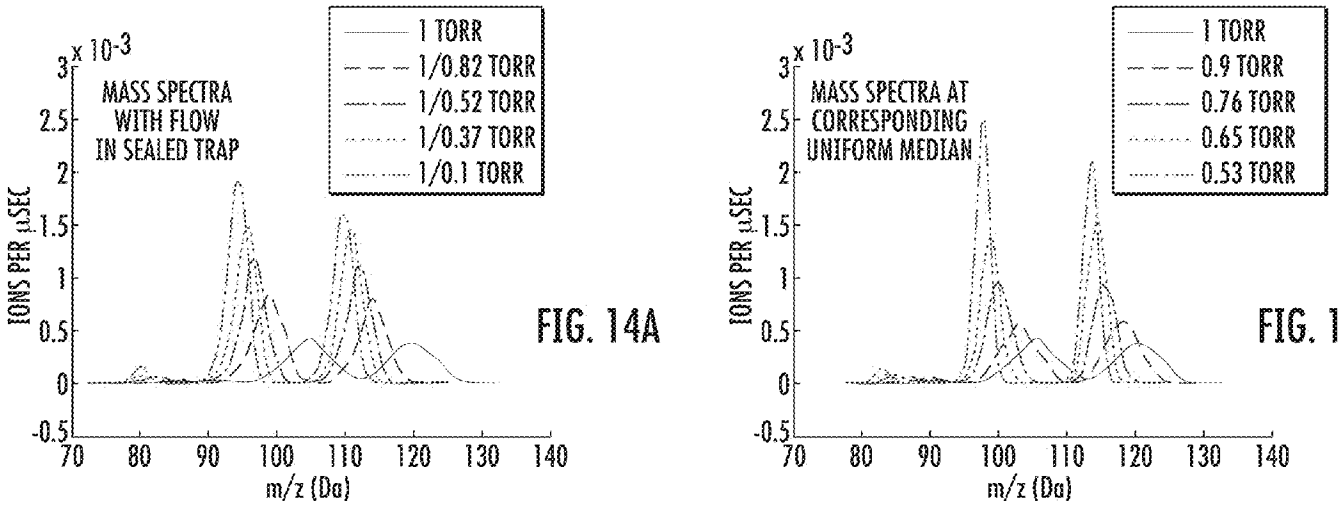
FIG. 14A
FIG. 14B
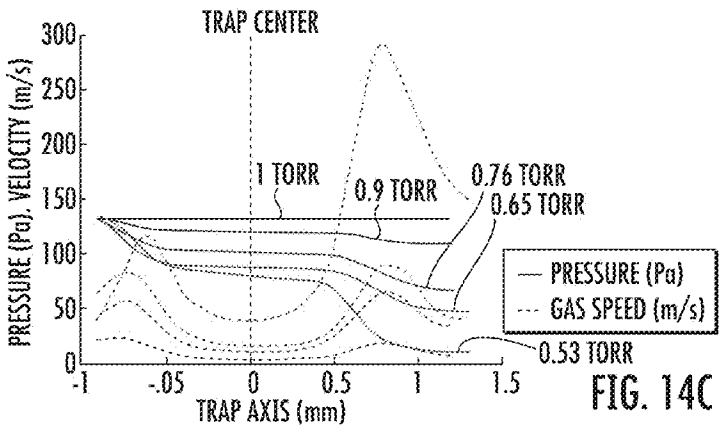
FIG. 14C

MASS SPECTROMETRY SYSTEMS WITH CONVECTIVE FLOW OF BUFFER GAS FOR ENHANCED SIGNALS AND RELATED METHODS

RELATED APPLICATIONS

This application claims the benefit of and priority to U.S. Provisional Application Ser. No. 62/010,050, filed Jun. 10, 2014, the contents of which are hereby incorporated by reference as if recited in full herein.

STATEMENT OF GOVERNMENT SUPPORT

This invention was made with government support under grant number W911NF-12-1-0539 awarded by the U.S. Army Research Office. The United States government has certain rights in the invention.

FIELD OF THE INVENTION

This invention is related to mass spectrometry and is particularly suitable for portable and/or compact high pressure mass spectrometers.

BACKGROUND OF THE INVENTION

Mass spectrometry is a powerful tool for indentifying and quantifying gas phase molecules. A mass spectrometry system has three fundamental components: an ion source, a mass analyzer and a detector. These components can take on different forms depending on the type of mass analyzer. Interest in portable mass spectrometry (MS) has increased due to potential uses where rapid in situ or field measurements may be of value. Conventional mass spectrometers are unsuitable for these situations because of their large size, weight, and power consumption (SWaP). See, e.g., Whitten et al., *Rapid Commun. Mass Spectrom.* 2004, 18, 1749-52.

There remains a need for portable, compact and lightweight mass spectrometers for chemical monitoring and analysis.

SUMMARY OF EMBODIMENTS OF THE INVENTION

Some embodiments of the invention are directed to a mass spectrometer (HPMS). The HPMS can include at least one mass analyzer ion trap with an injector endcap electrode, a ring electrode and an ejector endcap electrode. The HPMS can also include a first chamber holding the ion trap mass analyzer. The first chamber can be configured to have a first background pressure P1 during operation. The first background pressure P1 can be a high background pressure of between about 0.1 Torr and 1000 Torr. The HPMS can also include a second chamber with a detector in fluid communication with and downstream, but adjacent, the first chamber. The second chamber can be configured to have a second background pressure P2 that is less than P1. A ratio of P2/P1 can be less than 1 and greater than about 0.1. P2/P1 can generate an increase in peak height in at least one detected ion signal of at least 30% measured using a test sample of mesitylene, with the at least one detected ion signal associated with an ion of the test sample, relative to when the first and second chambers are operated at a common pressure where P1=P2. The HPMS can also include at least one vacuum pump in communication with the first and/or second chambers for generating P1 and/or P2.

The mass analyzer and pressure ratio P2/P1 can be configured to generate convective flow of buffer gas with a Knudsen value Kn less than 10 to thereby generate gas flow and/or transport in a viscous or transition regime.

The ratio P1/P2 can selected to generate a detected ion signal with a peak height of ion intensity of an ion in a sample under analysis that is increased from a corresponding baseline peak intensity value obtained when P2=P1 by between 30% to about 200%, measured with respect to an ion or ions associated with the mesitylene test sample.

The ratio P2/P1 can be between about 0.9 and about 0.10, such as one of: 0.90, 0.85, 0.80, 0.75, 0.70, 0.65, 0.60, 0.55, 0.50, 0.45, 0.40, 0.35, 0.30, 0.25, 0.20, 0.15, and about 0.10.

In some embodiments, one of P1 and P2 can be at 100 mTorr or above.

In some embodiments P2 is above 500 mTorr, and P1 is between 1 Torr and 10 Torr.

At least a perimeter portion of the ring electrode can be sealably attached to a corresponding perimeter portion of the ejector and/or the injector endcap electrode to define a sealed space therebetween to thereby block incoming buffer gas.

The HPMS can include a buffer and sample gas inlet that is in fluid communication with the first chamber and allows a sample and buffer gas to enter the first chamber.

The injector endcap electrode and the ejector endcap electrode can both be sealably attached to the ring electrode to define a respective sealed space therebetween whereby incoming buffer gas is primarily only allowed through one or more apertures extending axially through the injector endcap electrode.

The HPMS can include a solid, gas-impermeable wall or partition separating the first and second chambers, with the ion trap directly or indirectly sealably attached thereto. The internal wall or partition can have at least one axially extending flow path channel aligned with the ejector endcap aperture or apertures to direct a mass flux of buffer gas to the second chamber.

Other embodiments are directed to high-pressure mass spectrometers (HPMS). A respective HPMS can include at least one mass analyzer ion trap. The mass analyzer ion trap can include an injector endcap electrode, a ring electrode and an ejector endcap electrode. At least a perimeter portion of the ring electrode can be sealably attached to a corresponding perimeter portion of the injector electrode and/or the ejector electrode to define a sealed space therebetween to thereby block incoming buffer gas. The HPMS can also include a first chamber or sub-chamber holding the ion trap mass analyzer. The first chamber or sub-chamber can be configured to have a first background pressure P1 during operation, the first background pressure P1 being a high background pressure. The HPMS can also include a second chamber or sub-chamber with a detector in fluid communication with and downstream, but adjacent, the first chamber or sub-chamber. The second chamber or sub-chamber can be configured to have a second background pressure P2 that is less than P1.

A ratio of P2/P1 can be less than 1 and greater than about 0.1. The mass analyzer and pressure ratio P2/P1 can be configured to generate convective flow of buffer gas with a Knudsen value Kn less than 10 to thereby generate gas transport and/or flow in a viscous regime.

The injector endcap electrode and the ejector endcap electrode can both be sealably attached to the ring electrode to define a respective sealed space therebetween whereby incoming buffer gas is primarily allowed through one or more apertures extending axially through the injector endcap electrode.

The sealed space of the ring and endcap electrode can have a leak rate of no more than 10% of an average gas flow rate through the mass analyzer.

The ratio P2/P1 can generate an increase in peak height in at least one detected ion signal of at least 30% relative to when the first and second chambers or sub-chambers are operated at a common pressure, with the at least one detected ion signal associated with an ion of the test sample.

In some embodiments, P1 is at or above 50 mTorr or at or above 100 mTorr.

In some embodiments, P2 can be above 500 mTorr and P1 can be between 1 Torr and 10 Torr.

The HPMS can include a gas impermeable, electrically insulating sealant that surrounds an axially extending ring electrode through-aperture or apertures, residing between the ring electrode and the ejector endcap electrode and/or residing between the injector endcap electrode and the ring electrode to provide the sealed attachment.

The HPMS can include a mounting fixture holding the ion trap inside the first and/or second chamber or sub-chamber housing. The mounting fixture can have a planar surface with an axially extending open channel residing downstream of the ion trap. The planar surface can abut an inwardly extending ledge of a housing holding the first and/or second chamber or sub-chamber.

The HPMS can include a mounting fixture holding the ion trap inside the first and/or second chamber or sub-chamber. The mounting fixture can have a planar surface residing upstream of the ion trap that can hold the ion trap against a wall or partition separating the first and second chambers or sub-chambers.

The HPMS can include a solid, gas-impermeable wall or partition separating the first and second chambers or sub-chambers, with the ion trap directly or indirectly sealably attached thereto. The internal wall or partition can have at least one axially extending flow path channel aligned with the ejector endcap aperture or apertures to direct mass flux buffer gas to the detector.

The HPMS can include a housing. The first chamber or sub-chamber can be a first chamber and the second chamber or sub-chamber can be a second chamber that resides adjacent the first chamber. The HPMS can also include an electron ionizer inside the first chamber or in fluid communication with the first chamber, residing upstream of the mass analyzer. The mass analyzer can be closely spaced apart from the detector to reside within a distance of between about 1 mm to about 10 mm thereof. The ion trap mass analyzer can be either: (a) a CIT with critical dimensions $r_0$ or $z_0$ less than about 1 mm; or (b) a Stretched Length Ion Trap (SLIT) with the ring electrode having an aperture which extends along a longitudinal direction and the central electrode surrounds the aperture in a lateral plane perpendicular to the longitudinal direction to define a transverse cavity for trapping charged particles. The aperture in the ring electrode can be elongated in the lateral plane and may have a ratio of a major dimension to a minor dimension that is greater than 1.5.

In some embodiments, the pressure P1 can be between 1 Torr and 10 Torr. The ratio P1/P2 can be selected to generate peak heights of ion intensity of a respective ion in a sample under analysis that are increased from baseline peak intensity value obtained when P2=P1 by between about 30% to about 200%, measured using an ion associated with a test sample comprising mesitylene.

The HPMS can include at least one vacuum pump in fluid communication with at least one of the first chamber or sub-chamber or the second chamber or sub-chamber.

The HPMS can include a buffer gas and sample inlet in fluid communication with the first chamber. The first chamber or sub-chamber can be a first chamber and the second chamber or sub-chamber can be a second chamber that resides adjacent the first chamber. The HPMS can include a single vacuum pump attached to a vacuum port on the second chamber and can be configured to also generate the high pressure of P1 using a manifold and valve in communication with the vacuum pump in cooperation with control of pressure associated with the buffer gas and sample entry into the inlet.

Yet other embodiments are directed to a mass spectrometer (HPMS) that includes: at least one mass analyzer ion trap with an injector endcap electrode, a ring electrode and an ejector endcap electrode and a first chamber or sub-chamber comprising the ion trap mass analyzer. The first chamber or sub-chamber is configured to have a first background pressure P1 during operation, the first background pressure P1 being a high background pressure of between about 0.1 Torr and 1000 Torr. The HPMS also includes a second chamber or sub-chamber with a detector in fluid communication with and downstream, but adjacent, the first chamber. The second chamber or sub-chamber can be configured to have a second background pressure P2 that is less than P1, wherein a ratio of P2/P1 is between 0.9 and about 0.1. The HPMS also includes at least one vacuum pump in communication with the first and/or second chambers or sub-chambers for generating P1 and/or P2.

The ratio P2/P1 can be one of: 0.90, 0.85, 0.80, 0.75, 0.70, 0.65, 0.60, 0.55, 0.50, 0.45, 0.40, 0.35, 0.30, 0.25, 0.20, 0.15, and about 0.10 and can generate an increase in peak height in at least one detected ion signal of at least 30% relative to when the first and second chambers or sub-chambers are operated at a common pressure where P1=P2, measured using an ion associated with a test sample comprising mesitylene.

Still other embodiments are directed to methods of operating a high pressure mass spectrometers to enhance signals detected by an onboard detector. The methods include: (a) providing a pressure mass spectrometer with an ion trap mass analyzer and detector, wherein the ion trap mass analyzer comprises a ring electrode with at least one aperture extending therethrough, an injector endcap with at least one aperture extending therethrough and an ejector endcap electrode with at least one aperture extending therethrough; (b) generating a first background pressure P1 about the ion trap mass analyzer, wherein P1 is greater than 0.01 Torr; (c) generating a second background pressure P2 about the detector, wherein 0.1<P2/P1<1; and (d) generating at least one enhanced ion peak with an increase in peak height of at least 30% in detected signal relative to when P2=P1, as measured using an ion associated with a test sample of mesitylene.

The ion trap mass analyzer and pressure ratio P2/P1 can be configured to generate a convective flow of buffer gas with a Knudsen value (Kn) less than 10 to thereby generate gas flow and/or transport in a viscous regime.

The ion trap mass analyzer can include a sealant between the ring electrode and at least one of the injector endcap electrode and the ejector endcap electrode. The sealant can be configured to surround the ring electrode at least one aperture and the respective ejector endcap at least one aperture.

The method can include generating convective flow of buffer gas using the mass analyzer and P2/P1 and P2 can be between 10 mTorr to 900 mTorr.

The ratio P2/P1 can be less than 1 and equal to or greater than about 0.1.

The ring electrode can be sealably attached to both the ejector and injector endcap electrodes and gas flow and/or ion transport can primarily only through the electrode apertures.

The method can include generating convective flow of buffer gas using the mass analyzer and P2/P1. P1 can be between about 1 Torr and 10 Torr and P2/P1 can be between 0.9 and about 0.1, such as one of 0.90, 0.85, 0.80, 0.75, 0.70, 0.65, 0.60, 0.55, 0.50, 0.45, 0.40, 0.35, 0.30, 0.25, 0.20, 0.15, and 0.10.

The ion trap can be a microscale ion trap.

Yet other aspects are directed to a high-pressure mass spectrometer (HPMS) that includes: a housing and a first chamber or sub-chamber held by the housing having at least one sample and/or buffer gas inlet port; at least one mass analyzer microscale ion trap with an injector endcap electrode, a ring electrode and an ejector endcap electrode held in the first chamber or sub-chamber. The first chamber or sub-chamber is configured to have a first background pressure P1 during operation, the first background pressure P1 being a high background pressure of between about 0.1 Torr and 10 Torr. The HPMS can also include an ionizer held by the housing in fluid communication with the at least one mass analyzer ion trap; a second chamber or sub-chamber held by the housing comprising a detector in fluid communication with and downstream, but adjacent, the first chamber; and at least one vacuum pump in communication with the first and second chambers or sub-chambers. The second chamber or sub-chamber is configured to have a second background pressure P2 that is less than P1. A ratio of P2/P1 is less than 1 and greater than 0.1. The ratio P2/P1 generates an increase in peak height in at least one detected ion signal of at least 30% relative to when the first and second chambers are operated at a common pressure where P1=P2, measured using an ion associated with a test sample of mesitylene.

At least a perimeter portion of the ring electrode can be sealably attached to a corresponding perimeter portion of at least one of the injector endcap or ejector endcap electrodes to define a sealed space therebetween to thereby block incoming buffer gas.

The at least one vacuum pump can be a single vacuum pump attached to a vacuum port in the second chamber.

Other aspects of the invention are directed to microscale mass analyzer ion traps. The microscale traps include an injector endcap electrode, a ring electrode and an ejector endcap electrode. At least a perimeter portion of the ring electrode can be sealably attached to a corresponding perimeter portion of at least one of the ejector or injector electrodes to define a sealed space therebetween to thereby block incoming buffer gas from entering through perimeter spaces in operation.

The injector endcap electrode and the ejector endcap electrode can both be sealably attached to the ring electrode to define a respective sealed space therebetween whereby, in position in a mass spectrometer, incoming buffer gas can primarily be allowed through one or more apertures extending axially through the injector endcap electrode.

The sealed space of the ring and endcap electrode can have a leak rate of no more than 10% of an average gas flow rate through the ion trap during normal operation in a high background pressure chamber.

The ion trap mass analyzer can be either: (a) a CIT with critical dimensions $r_0$ or $z_0$ less than about 1 mm; or (b) a Stretched Length Ion Trap (SLIT) with the ring electrode having an aperture which extends along a longitudinal direction and the central electrode surrounds the aperture in a lateral plane perpendicular to the longitudinal direction to define a transverse cavity for trapping charged particles. The aperture in the ring electrode can be elongated in the lateral plane.

Optionally, the SLIT aperture can have a ratio of a major dimension to a minor dimension that is greater than 1.5.

The mass analyzer can operate with a pressure differential across the sealed ion trap so that pressure outside the injector electrode has a background pressure P1 during operation. The first background pressure P1 can be a high background pressure of between about 0.01 Torr and 1000 Torr. Pressure outside the ejector electrode can be at a second background pressure P2 that is less than P1. A ratio of P2/P1 can be less than 1 and greater than 0.1. The ratio P2/P1 can be one of about 0.90, 0.85, 0.80, 0.75, 0.70, 0.65, 0.60, 0.55, 0.50, 0.45, 0.40, 0.35, 0.30, 0.25, 0.20, 0.15, and about 0.10. The ratio P2/P1 can generate an increase in peak height in at least one detected ion signal of at least 30% measured using a test sample of mesitylene, with the at least one detected ion signal associated with an ion of the test sample, relative to when the first and second chambers are operated at a common pressure where P1=P2.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

BRIEF DESCRIPTION OF THE DRAWINGS

FIGS. 14A and 14B are plots of ions per μsecond versus m/z (Da) comparing mass spectra obtained with flow (FIG. 14A) with mass spectra without flow (FIG. 14B) at pressures equal to reduced pressures inside the trap.

FIG. 14C illustrates pressure (Pa), velocity (m/s) versus trap axis (mm) for pressure (Pa) and gas speed (m/s) showing conversion of pressure into gas flow kinetic energy based on simulations.

DESCRIPTION OF EMBODIMENTS OF THE INVENTION

Figure 1A:
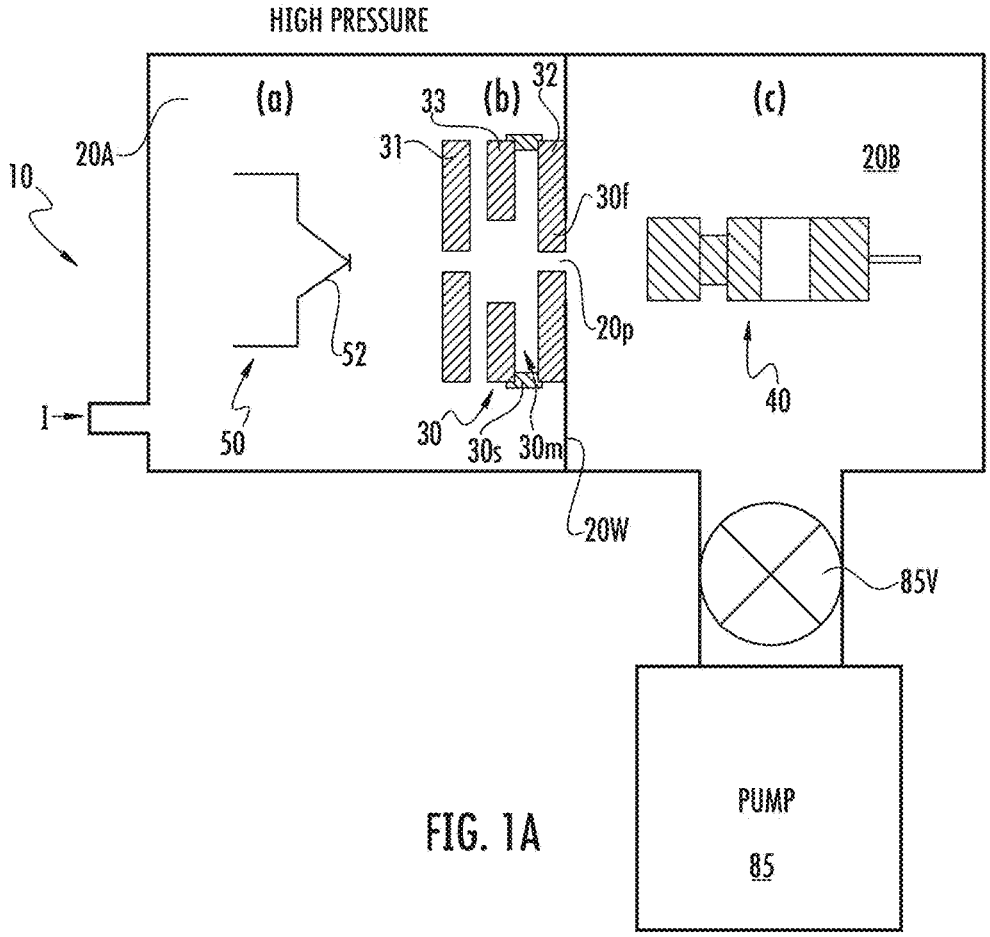
FIG. 1A is a schematic illustration of an exemplary mass spectrometer according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. In the drawings, the thickness of lines, layers, features, components and/or regions may be exaggerated for clarity and broken lines illustrate optional features or operations, unless specified otherwise.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "comprises," "comprising," "includes," and/or "including" when used in this specification, specify the presence of stated features, regions, steps, operations, elements, and/or components, but do not preclude the presence or addition of one or more other features, regions, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when a feature, such as a layer, region or substrate, is referred to as being "on" another feature or element, it can be directly on the other feature or element or intervening features and/or elements may also be present. In contrast, when an element is referred to as being "directly on" another feature or element, there are no intervening elements present. It will also be understood that, when a feature or element is referred to as being "connected", "attached" or "coupled" to another feature or element, it can be directly connected, attached or coupled to the other element or intervening elements may be present. In contrast, when a feature or element is referred to as being "directly connected", "directly attached" or "directly coupled" to another element, there are no intervening elements present. Although described or shown with respect to one embodiment, the features so described or shown can apply to other embodiments.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the present application and relevant art and should not be interpreted in an idealized or overly formal sense unless expressly so defined herein. Well-known functions or constructions may not be described in detail for brevity and/or clarity.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The term "about" with respect to a numerical value means that the stated number can vary from that value by +/−10%.

The term "analyte" refers to a molecule or chemical(s) in a sample undergoing analysis. The analyte can comprise chemicals associated with any industrial products, processes or environments or environmental hazards, toxins such as toxic industrial chemicals or toxic industrial materials, organic compounds, and the like. Moreover, analytes can include biomolecules found in living systems or manufactured such as biopharmaceuticals.

The term "buffer gas" refers to any gas or gas mixture that has neutral atoms such as air, nitrogen, helium, hydrogen, argon, and methane, by way of example.

The term "mass resonance scan time" refers to mass selective ejection of ions from the ion trap with associated integral signal acquisition time.

The term "mass" is often inferred to mean mass-to-charge ratio and its meaning can be determined from context. When this term is used when referring to mass spectra or mass spectral measurements, it is implied to mean mass-to-charge ratio measurements of ions.

The terms "convective" when used with "gas flow" refers to a flow of buffer gas through the ring electrode of an ion trap mass analyzer, typically a microscale ion trap, operated at high background pressure so that the convective flow of buffer gas is in a viscous (continuum or transitional) gas flow regime to transport analyte molecules/ions for analysis. The convective gas flow may optionally also, or alternatively, include a convective gas flow transport of ions. The analyte molecules in the flow of buffer gas into/through the ion trap mass analyzer is a minority component as is well known to those of skill in the art. The convective gas flow and/or transport described herein for some embodiments of the invention has a Knudsen number (Kn) that is 10 or below, and in some embodiments, near unity or smaller. Kn is a ratio of the mean free path length of the molecules of a fluid or gas to a characteristic length used to describe the important length scale of an experiment. By way of comparison, Kn>1 is associated with free molecular gas flow.

The term "microscale" with respect to ion trap mass analyzers refers to miniature sized ion traps with a critical dimension that is in the millimeter to submillimeter range, typically with associated apertures in one or more electrodes of the ion trap having a critical dimension between about 0.001 mm to about 5 mm, and any sub-range thereof. The ion trap electrode central aperture can take on different geometries such as a cylindrical or slit shaped void and arrays of voids are possible.

Mass spectrometry has historically been performed under conditions of high vacuum. The reason for this condition is that performance is enhanced if ions do not collide with background gas molecules during their trajectory from an ion source through a mass analyzer arriving at a detector. Ion-molecule collision events scatter the ions away from their intended trajectory, often degrading mass resolution and signal strength. The vacuum that achieves sufficient resolution in conventional systems can be formalized through the Knudsen number, Kn. Mass spectrometry is typically performed in the molecular flow regime defined as Kn>1, and in conventional practice, Kn is between about 100 and over 10,000 for conventional mass spectrometry systems.

Table 1 below includes the calculated mean free path (mfp) for helium and nitrogen at a range of pressures from $10^{-6}$-760 Torr. Collision cross sections for helium and nitrogen are determined from the van der Walls volumes of each and average collisional radii used in the mfp calculations are 0.14 nm and 0.18 nm respectively. See, e.g., Knapman, et al, *Intl. J. Mass Spectrom.*, 2010, 298, 17-23, the contents of which are hereby incorporated by reference as if recited in full herein. The mfp values were calculated from Equation 1 where k is Boltzmann's constant, T is temperature in Kelvin, d is the collision diameter, and P is the gas pressure. A temperature of 300K is assumed in Table 1.

$$mfp = \frac{kT}{\sqrt{2}\,\pi d^2 P} \qquad \text{Equation 1}$$

A pressure of $10^{-6}$ Torr or lower is a typical operating pressure of a linear quadrupole or time of flight mass analyzer and the critical length scale is on the order of 100 mm. Such values lead to Kn numbers of several hundred. A typical operational pressure of an ion trap mass spectrometer with a ring electrode radius of 10 mm is $10^{-4}$ Torr, leading to Kn numbers of about 100. The operating regime of primary interest in this application is at pressures greater than 50 mTorr and critical length scales, $z_0$ values, or, for certain trap configurations, $r_0$ values, of less than 1 mm. In all of these cases listed in Table 1, Kn is less than 10 and all but one example is less than unity.

TABLE 1

Knudsen number in microscale traps operated at high pressure

| Pressure (Torr) | mfp (mm) | | L (mm) | Kn (He) | Kn($N_2$) |
|---|---|---|---|---|---|
| 0.000001 | 88920 | 53960 | 100 | 889.20 | 539.60 |
| 0.0001 | 889 | 540 | 10 | 88.92 | 53.96 |
| 0.01 | 8.9 | 5.4 | 1 | 8.89 | 5.40 |
| 0.1 | 0.89 | 0.54 | 1 | 0.89 | 0.54 |

TABLE 1-continued

Knudsen number in microscale traps operated at high pressure

| Pressure (Torr) | mfp (mm) | | L (mm) | Kn (He) | Kn($N_2$) |
|---|---|---|---|---|---|
| 0.5 | 0.18 | 0.11 | 0.5 | 0.36 | 0.22 |
| 1 | 0.089 | 0.054 | 0.25 | 0.356 | 0.216 |
| 10 | 0.0089 | 0.0054 | 0.1 | 0.089 | 0.054 |
| 760 | 0.000117 | 0.000071 | 0.01 | 0.012 | 0.007 |

Embodiments of the present invention perform mass spectrometry under unconventional conditions where Kn has values near unity and below (less than 10 and less than 1, for example). At such pressures and fundamental length scales, the mean free path is similar to, or less than, the critical experimental length scale. Embodiments of the invention maybe particularly suitable for Paul trap mass analyzers, commonly referred to as ion trap mass analyzers, that have fundamental length scales that are less than 1 mm, e.g., the radius of the ring electrode, $r_0$, is 1 mm or less. Embodiments of the invention are directed to high-pressure mass spectrometers that can be operated at pressures of about 50 mTorr and above or about 100 mTorr and above (e.g., to 1 Torr, 10 Torr, 100 Torr or 1000 Torr, for example) and/or with Kn values about less than 10, about one, or even less than one.

The term "high resolution" refers to mass spectra that can be reliably resolved to less than 1 Th, e.g., having a line width less than 1 Th (FWHM). "Th" is a Thompson unit of mass to charge ratio. The high resolution operation may allow the use of monoisotopic mass to identify the substance under analysis.

The term "high detector sensitivity" refers to detectors that can detect signals on a low end ranging from 1-100 charges per second.

The term "high pressure" refers to an operational background pressure in a chamber or sub-chamber holding a mass analyzer being between about 10 mTorr to about 100 Torr, typically between about 50 mTorr to about 10 Torr, and more typically between about 100 mTorr and about 10 Torr.

FIGS. 1A-1D and 2 are block diagrams of exemplary mass spectrometers 10. As is well known, a mass spectrometry system has three fundamental components: an ion source, a mass analyzer and a detector. These components can take on different forms depending on the type of mass analyzer.

Figure 1B:
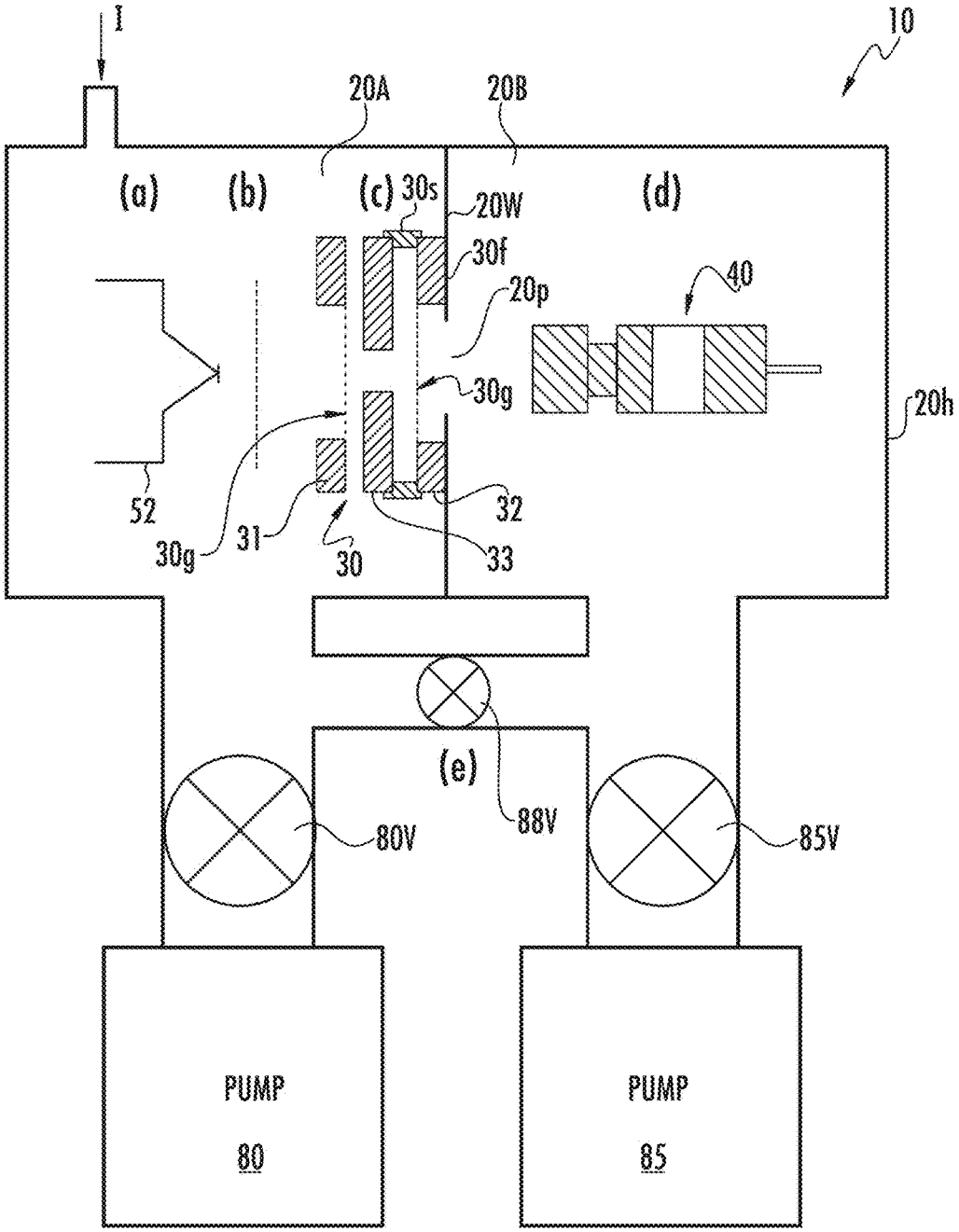
FIG. 1B is a schematic illustration of another exemplary mass spectrometer according to embodiments of the present invention.

As shown in FIGS. 1A-1D and 2, the first chamber, sub-chamber or chamber segment 20A has an ion trap 30 and an ionizer 50 (e.g., electron or ion source with emitter 52). The ionizer 50 resides upstream of at least one ion trap 30. The ionizer 50 can reside in the same chamber or sub-chamber 20A as the mass analyzer 30 or may reside in a separate chamber upstream of the mass analyzer 30 but in fluid communication with the first chamber 20A. The second chamber, sub-chamber or chamber segment 20B has a detector 40 (that may include an electron multiplier) that resides downstream of the ion trap 30. In the embodiment shown in FIGS. 1A-1D and 2, the ion trap 30 comprises an ion trap with an array of closely spaced apart electrodes (conductors). The electrodes comprise a center (ring) electrode 33 residing between two endcap electrodes 31, 32. FIG. 1B illustrates that the endcap electrodes 31, 32 can include a conductive, typically metallic, mesh or grid configuration 30*g*.

Figure 6A:
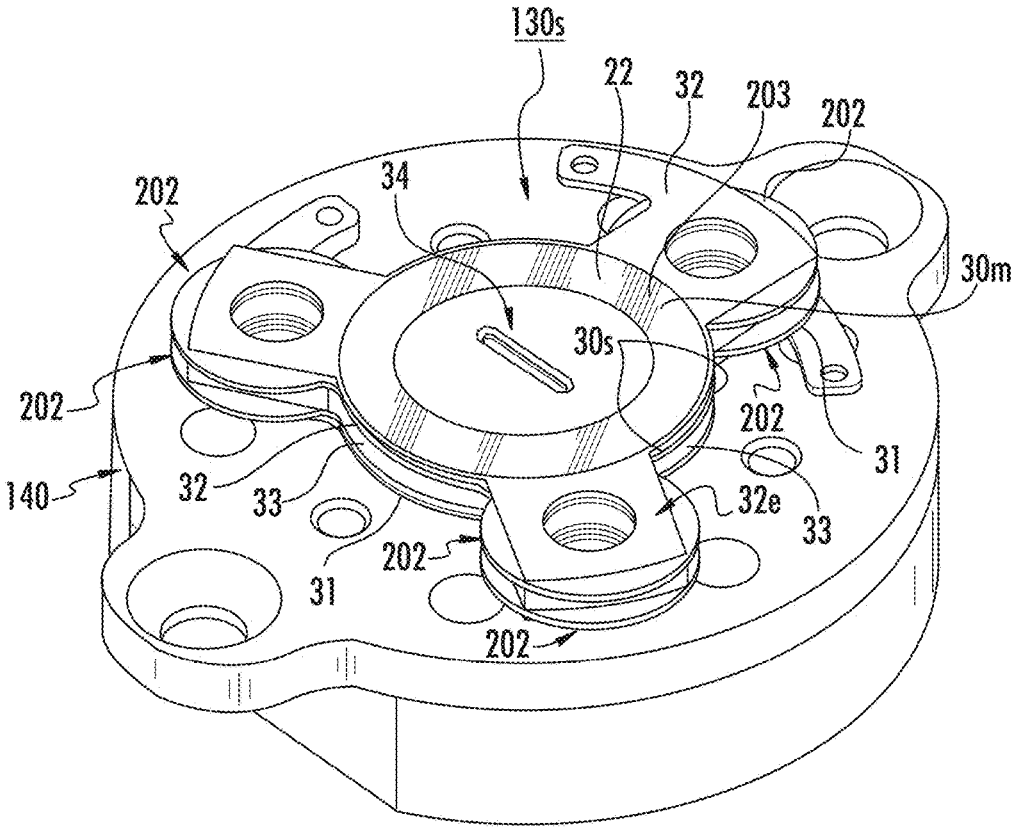
FIG. 6A is a top perspective view of an exemplary mass analyzer subassembly according to embodiments of the present invention.

In some embodiments, one of the endcap electrodes 31, 32 can be sealably attached to the ring electrode 33 with a gas impermeable electrically insulating sealant 30*m* (FIGS. 3B, 3C) to define a sealed gap space 30*s* therebetween. The sealant 30*m* can reside along an outer end portion of a respective electrode pair (e.g., 33 and 32 and/or 33 and 31) and may extend laterally inside a distance as indicated by the broken line boxes adjacent the sealant 30*m*. The electrodes can have axially aligned apertures with a distance "b" between centers of adjacent apertures. The apertures can be arranged in a regular pattern or may be random. The ring electrode 33 can have one or more apertures 33*a* that will generally be larger than the first or second endcap electrode apertures 31*a*, 32*a* (FIGS. 6A, 6C, for example). The term "ring electrode" refers to the center electrode in the ion trap array that is between the end cap or end electrodes 31, 32 and is not required to have a ring shape form factor, e.g., either in an outer perimeter or in a bounding channel of a respective ion trap. As is well known, a respective ion trap 30 can have short tubular channels of different diameters of aligned end cap and ring apertures.

As shown in FIGS. 1A-1D and 2, the mass spectrometer 10 can include two adjacent chambers or chamber segments 20A, 20B typically separated by a solid, gas impermeable member, partition or wall 20*w* with a defined gas exit access path 20P providing fluid communication between the chambers or chamber segments 20A, 20B. The spectrometer 10 is configured to operate with differentially-pumped chambers or chamber segments 20A, 20B. That is, each chamber or chamber segment 20A, 20B is held at a different background pressure, the first chamber 20A is held at a high background pressure P1 and the second 20B is held at a lower pressure P2, which may also be at a high background pressure. The term "chamber segment" refers to a sub-volume of a common chamber. It is contemplated that while dual chambers are preferred, a single chamber with a shape or configuration that can provide suitably controlled dual pressure regions for differential pressure operation may also be used, particularly where only a slight reduced pressure (e.g., 1-10%) is used for the detector side of the chamber.

Figure 1C:
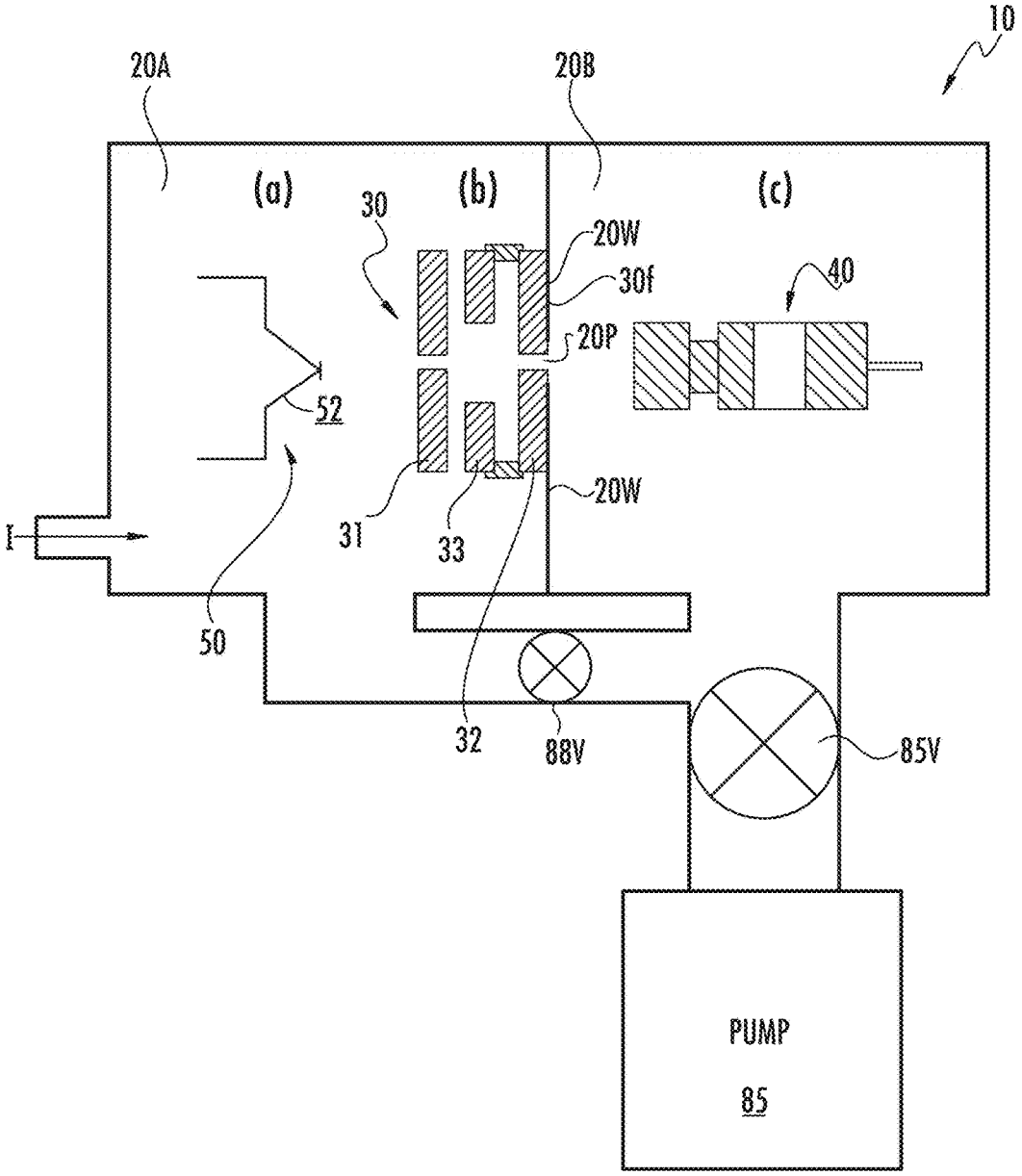
FIG. 1C is a schematic illustration of another exemplary mass spectrometer according to embodiments of the present invention.
Figure 1D:
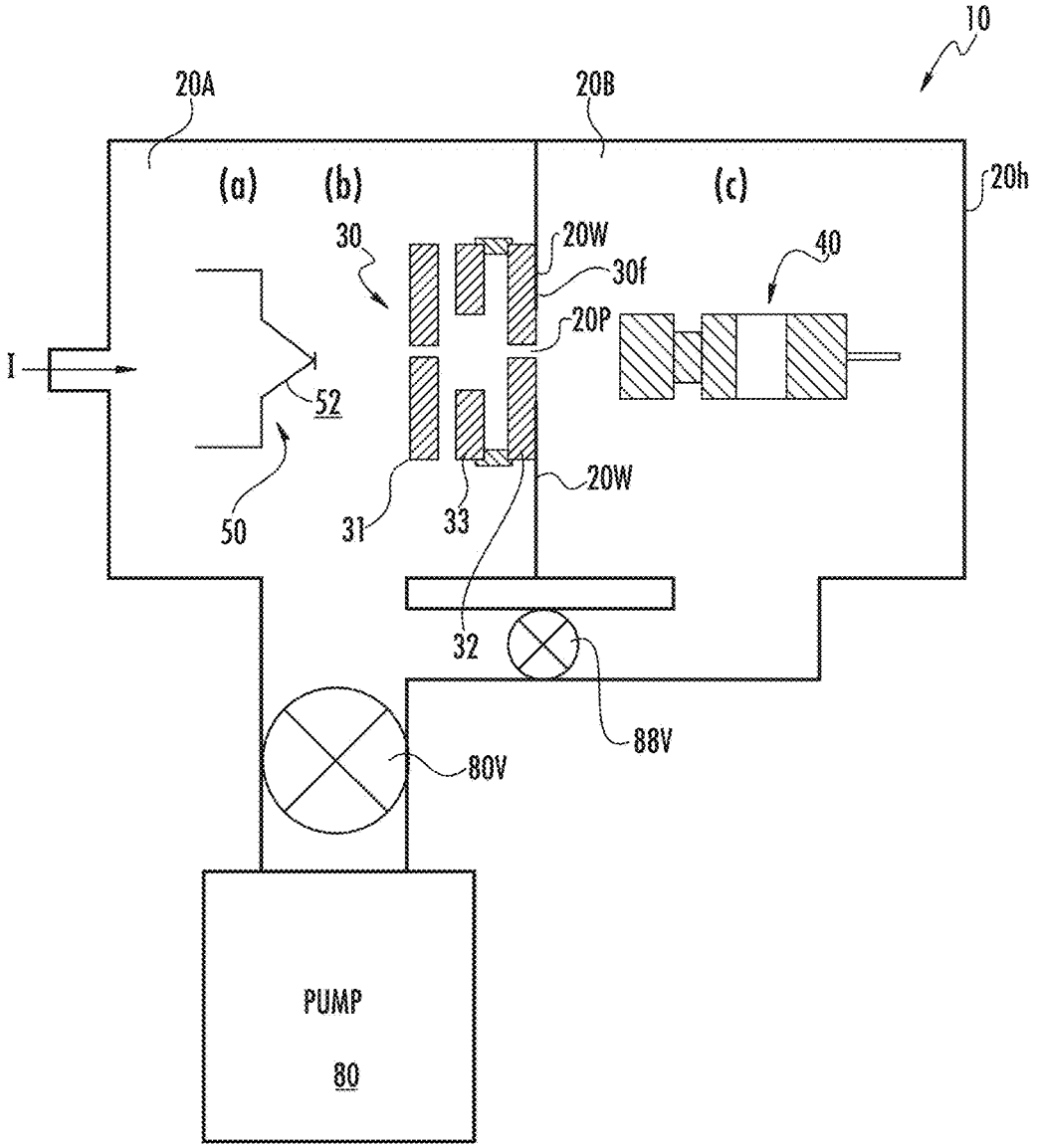
FIG. 1D is a schematic illustration of another exemplary mass spectrometer according to embodiments of the present invention.

FIGS. 1A, 1C and 1D illustrate that the mass spectrometer 10 includes one vacuum pump that can generate the differential pressure. FIGS. 1A and 1C show the vacuum pump 85 on the detector side of the housing 20*h*, typically with a control valve 85V in fluid communication with at least the second chamber 85 for generating the background pressure P2. The pressure P1 in the other chamber 20A can be generated by controlling the leak rate or exchange between the two chambers 20A, 20B and/or controlling the intake via sample and/or buffer gas inlet I using flow and/or pressure control devices or configurations, such or a leak or other valve 88*v* to adjust pressure between one or both of the chambers or sub-chambers 20A, 20B, inlet valve or capillary intake configuration at the inlet I, for example. Thus, the pump 85 can indirectly help generate the pressure P1, using bleed lines, valves, manifolds and the like. P2 may be held at a high pressure, e.g., about 500 mTorr or above. It is also noted that more than one inlet I into the first chamber or subchamber 20A can be used for the sample and/or the buffer gas, where used.

Typical sample S inlet flow rates into one or more inlets I are about 1 sccm but may be greater or smaller.

FIG. 1D illustrates that the vacuum pump 80 is on the ionizer 50 and mass analyzer 30 side of the chamber 20A. The pressure P2 in chamber 20B can be generated by controlling the leak rate or exchange between the two chambers 20A, 20B, such as with a leak valve. Alternatively or additionally, other pressure drop means can be used including a shaped flow path with convergence, divergence, turns, surface roughness and other physical properties so that a small pressure drop may be generated across the partition using the shape of the flow path, a fan at the partition 20*w* or combinations of same. Thus, the pump 80 can indirectly help generate the pressure P2, using shaped flow paths, fans and the like. P1 may be held at a high pressure, e.g., about 1 Torr or above and P2 may be at a smaller pressure caused by the pressure drop. This pressure drop can be such that P2/P1 is less than one, typically between about 0.10 and about 0.95, for example. The ratio P2/P1 can be one of the following: 0.95, 0.90, 0.85, 0.80, 0.75, 0.70, 0.65, 0.60, 0.55, 0.50, 0.45, 0.40, 0.35, 0.30, 0.25, 0.20, 0.15, and 0.10.

FIG. 1B illustrates that the mass spectrometer 10 includes a plurality of pumps 80, 85, at least one for each chamber or chamber segment 20A/20B. Optionally, the mass spectrometer 10 may also include a leak or other control valve 88*v* to adjust pressure in one or both of the chambers or chamber segments 20A, 20B. The device 10 can be configured to employ more than one pump per chamber/compartment 20A, 20B. Where more than one pump is used for a respective chamber/compartment 20A, 20B, a manifold can be used to provide an easy to use interface (not shown). The manifold can provide a plurality of ports for each chamber or for one chamber or compartment.

The two adjacent chambers/compartments 20A, 20B can be held by a compact, light weight housing 20*h* that may have a unitary body or may be provided as a plurality of attached housing bodies.

Figure 11:
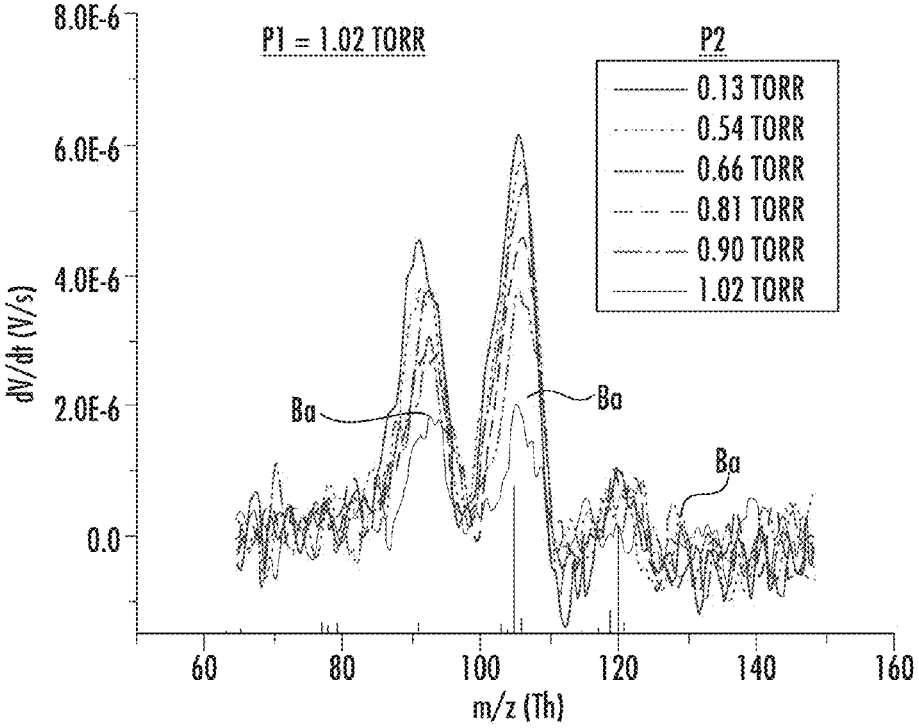
FIG. 11 is a graph of mesitylene Mass spectrum signal in 1 Torr $N_2$ ((dv/dt (V/s)) versus m/z (Th) with P1 at about 1.02 Torr and P2 varied between 1.02 Torr and 0.13 Torr according to embodiments of the present invention.
Figure 12:
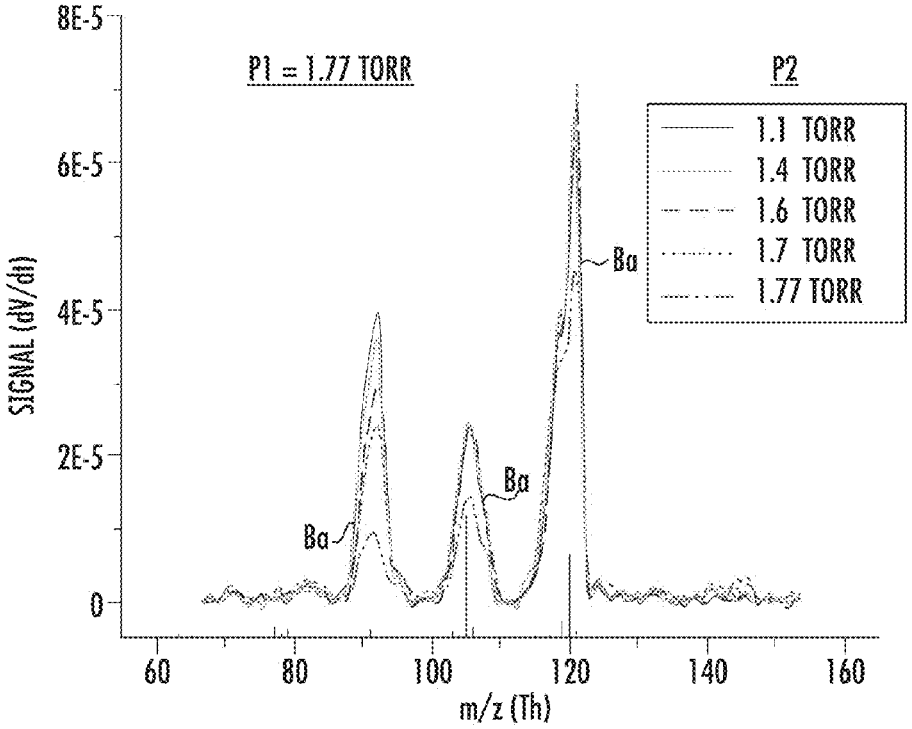
FIG. 12 is a graph of mesitylene Mass spectrum signal in 1.7 Torr He ((dv/dt (V/s)) versus m/z (Th) with P1 at about 1.77 Torr and P2 varied between 1.77 Torr and 1.1 Torr according to embodiments of the present invention.

The differential operational pressures P1, P2 can be selected to provide convective gas flow through the ring electrode 33 and ejector endcap 32 of the mass analyzer 30 toward the detector 40 for signal enhancement at the detector 40. The operational pressures P1, P2 and pressure ratios P2/P1 can vary or be dependent on whether a buffer gas is used and/or the type of buffer gas used as well as critical dimensions of components the mass spectrometer, for example, a critical dimension of some configurations of a microscale ion trap, $r_0$ and/or $z_0$. Evaluation of whether signal enhancement is provided by convective gas flow for a respective mass spectrometer 10 can be carried out by comparing operation with and without the differential pressure. FIGS. 11 and 12 show examples of signal variation based on both a common pressure and different pressures P1, P2. With an appropriate pressure differential, which may be relatively small, signal enhancement (peak amplitude) is achieved without broadening peak widths. Peaks of all masses are substantially uniformly affected.

FIGS. 11 and 12 illustrate that when P2 is the same as P1, a "baseline" signal "Ba" is generated which is representative of no convective gas flow. In comparison, when P2 is less than P1, an increase in peak amplitudes related to the analyte ions are generated, typically with one or more peak signals enhanced by at least 30% (typically without widening the respective peak width, or not widening by more than 5%, for example).

For purposes of evaluating infringement, the signal enhancement of respective MS devices can be evaluated using a known suitable control sample such as mesitylene and the P1=P2 operation versus a P2/P1<1 operation. Thus, whether there is analyte signal enhancement can be evaluated by comparing a baseline peak signal at P1=P2 with a corresponding peak signal at P2/P1<1 (or other claimed range where P2 is <P1), to determine if there is signal (peak) enhancement of an ion associated with a test sample of mesitylene in a mass spectrometer with an ion trap. The at least one detected ion signal associated with the ion of the test sample is not limited to just the molecular ion but any ions related to the test sample.

For example, as shown in FIG. 11, the baseline peak amplitude Ba is increased from about 2.0E-6 to at least 3.0E-6, and for most P2*s* measured, to at least 4.0E-6 (at 85 m/z and 105 m/z). The heavier mass at 120 m/z also shows increased peak signal height relative to the baseline value Ba, e.g., from 0 to about 1.0E-6. As shown in FIG. 12, the baseline peak amplitudes Ba that are below or at about 1.0E-5 are increased to be between about 2 E-5 or above (at 85 m/z and 105 m/z). The peak signal at 120 m/z increases from the baseline Ba of about 4 E-5 to between 6E-5 to about 7E-5.

Unexpectedly, signal improvement/enhancement using a relatively small pressure differential can provide enhanced signal for improved detection limits. Increasing pressure differentials does not significantly enhance signal (FIG. 13B).

It is noted that embodiments of the invention are directed to compact configurations of ion trap mass analyzers for a device that determines ion mass to charge ratio and can additionally provide relative abundance information for a number of ions ranging across mass to charge values. The specific examples described herein are particularly relevant to ion trap mass analyzers such as the Paul trap, cylindrical ion trap (CIT), Stretched Length Ion Trap (SLIT), and the rectilinear ion trap, for example.

Figure 2:
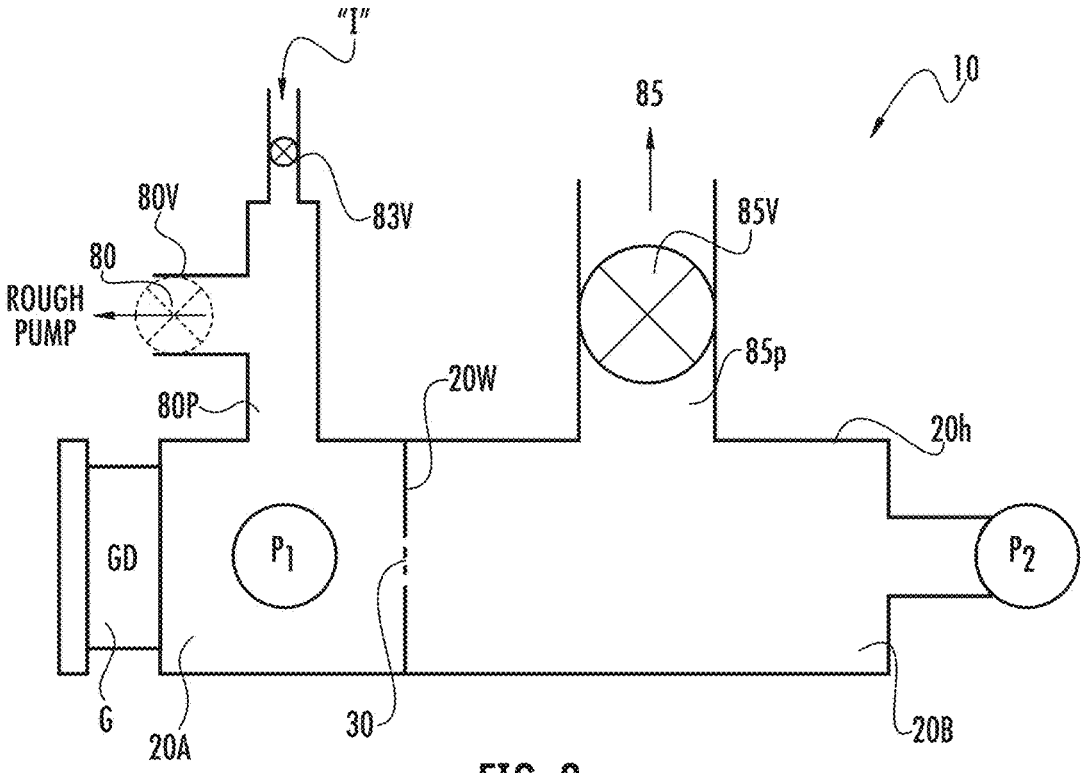
FIG. 2 is a schematic illustration of another exemplary mass spectrometer according to embodiments of the present invention.

In the embodiment shown in FIG. 2, the ion trap 30 comprises a microscale ion trap with a plurality of traps, e.g., in an experimental prototype of seven (7) traps in a respective array. However, the ion trap 30 can have other configurations and other numbers of traps in a corresponding array (e.g., aligned sets of apertures), such as between about 1-1000, typically between about 5-256, more typically between about 5-50, including 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49 and 50, for example.

In some embodiments, the ion trap 30 can have a stretched length ion trap (SLIT) configuration. See, e.g., U.S. Pat. No. 8,878,127, to Ramsey et al., entitled "Miniature Charged Particle Trap With Elongated Trapping Region For Mass Spectrometry, the contents of which are hereby incorporated by reference as if recited in full herein. However, other ion trap aperture shapes and aperture array configurations may be used.

Figure 7A:
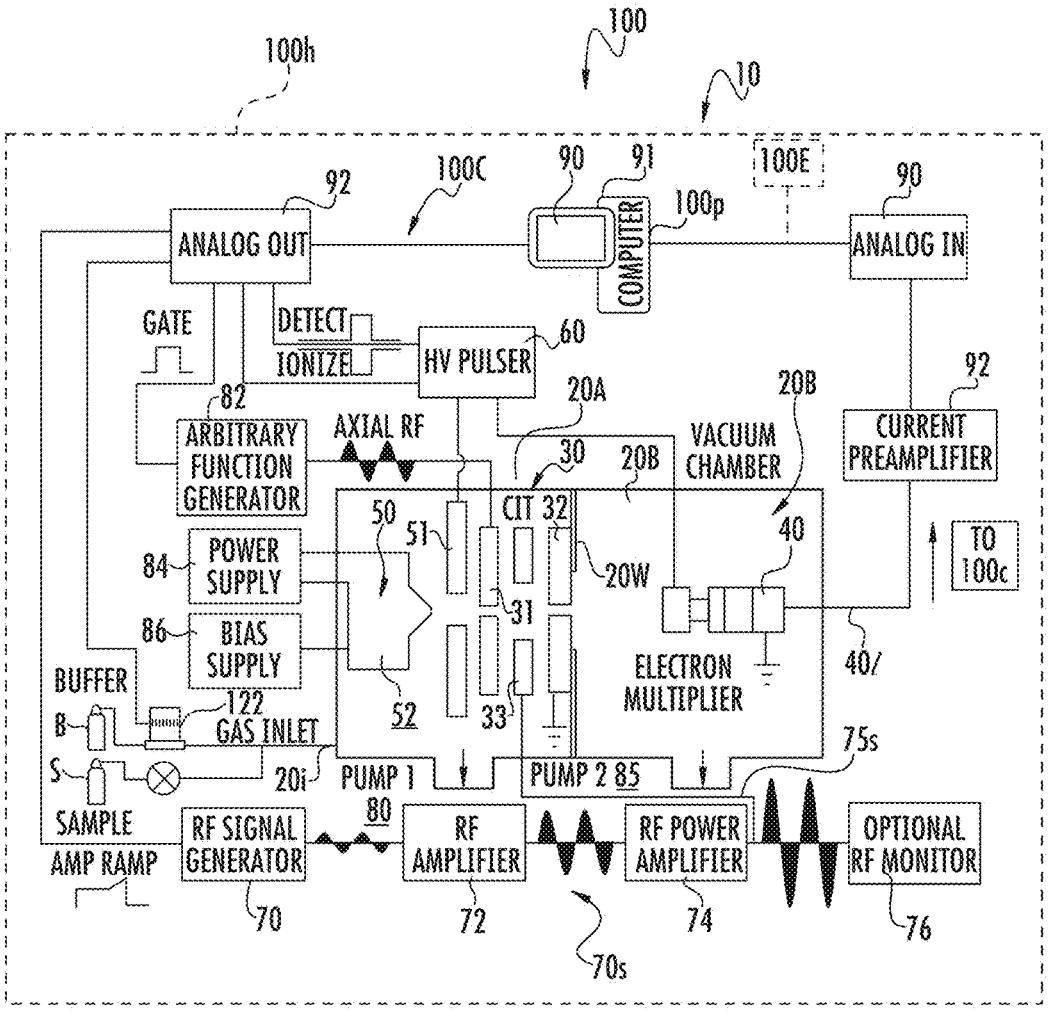
FIG. 7A is a block diagram of a mass spectrometry system according to embodiments of the present invention.

Referring to FIG. 7A (as will be discussed further below), the spectrometer 10 may also include additional operating components, including an optional gate lens electrode 51 and a control circuit 100*c* that provides the control signals for operating the various components.

The pressures P1 and P2 can be controlled so as to be substantially constant with a substantially fixed pressure ratio between chambers/compartments 20A and 20B and/or at least between the ring electrode of the mass analyzer and the detector interface. The mass spectrometer can run (flow gas through and perform mass resonance scans) continuously for at least a defined time period such as 8 hours, 12 hours, 24 hours, or over other time periods such as days, weeks, months and the like.

Pressure P1 and/or P2 may vary somewhat over time (e.g., 10-20%) without unduly affecting performance, but are typically held constant, on average over time of a suitable operational period, typically of at least 8 hours.

In some embodiments, each chamber or chamber segment 20A, 20B can include at least one valve 80*v*, 85*v* in communication to a respective vacuum pump, 80, 85, respectively, that can be used to control the pressure P1, P2 in the respective chambers, or sub-chambers.

FIG. 2 illustrates that the first chamber 20A can be in fluid communication with both a rough pump 80 via an optional rough pump valve 80*v* (shown in broken line) and an inlet valve 83*v*, shown as a needle valve. The inlet valve 83*v* resides between the sample and/or buffer gas inlet I and the chamber 20A. The pumps can be any suitable pump, typically small, light weight pumps. Examples of pumps include, for example only, a TPS Bench (SH110 and Turbo-V 81 M pumps) compact pumping system and/or a TPS compact (IDP-3 and TurboV 81M pumps) pumping system from Agilent Technologies, Santa Clara, Calif. Operational pressures above 100 mTorr can be easily achieved by mechanical displacement pumps such as rotary vane pumps, reciprocating piston pumps, or scroll pumps.

Figure 3A:
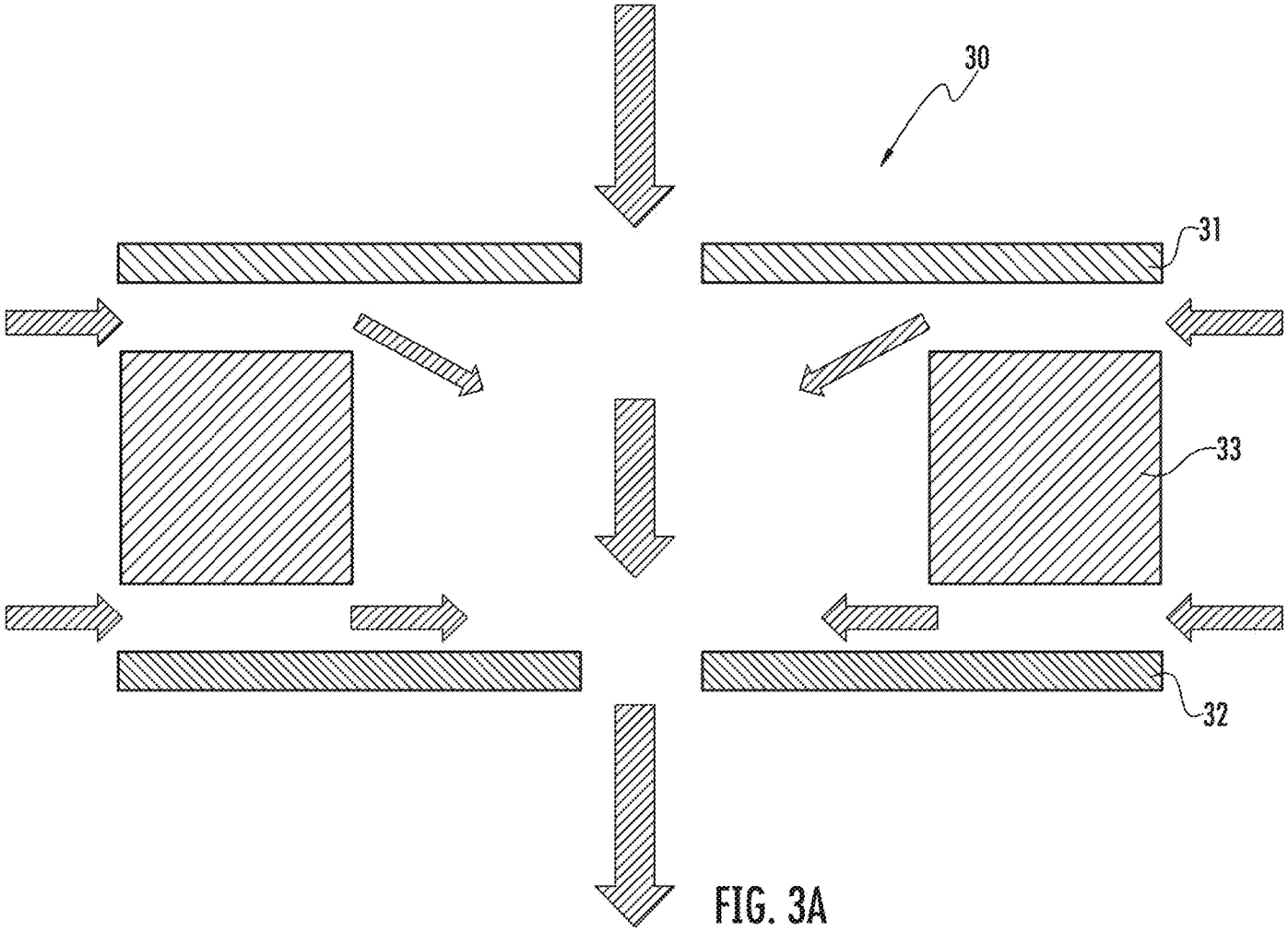
FIG. 3A is a schematic enlarged illustration of an unsealed mass analyzer ion trap.

FIG. 3A illustrates an unsealed ion trap 30. Buffer gas B has the flow directions shown, including flow in from a perimeter space between the endcap electrode 32 and the ring electrode 33. The flow direction of the center arrow indicates a longitudinal (also known as an axial direction).

Figure 3B:
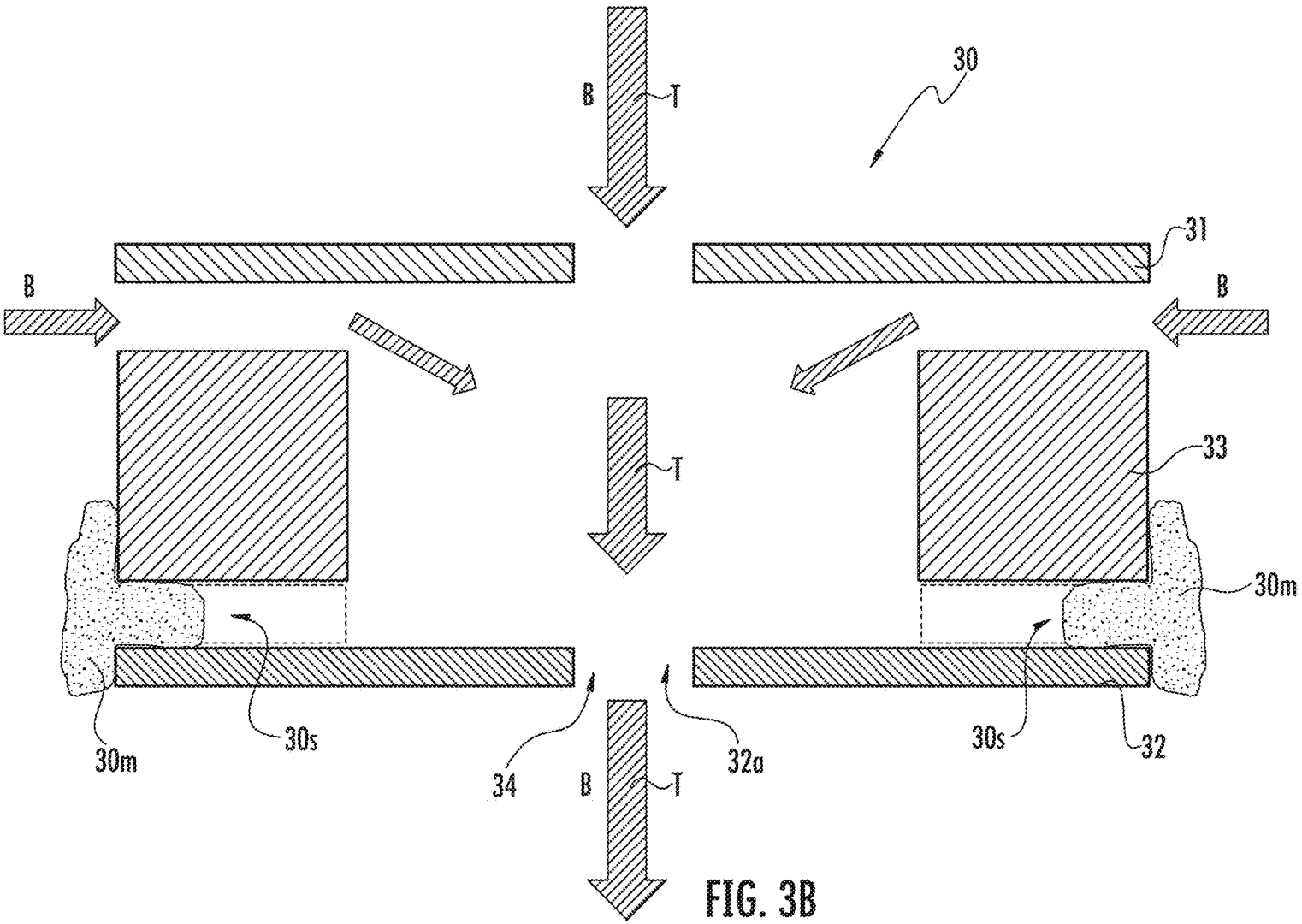
FIG. 3B is a schematic enlarged illustration of a sealed ion trap according to embodiments of the present invention.
Figure 3C:
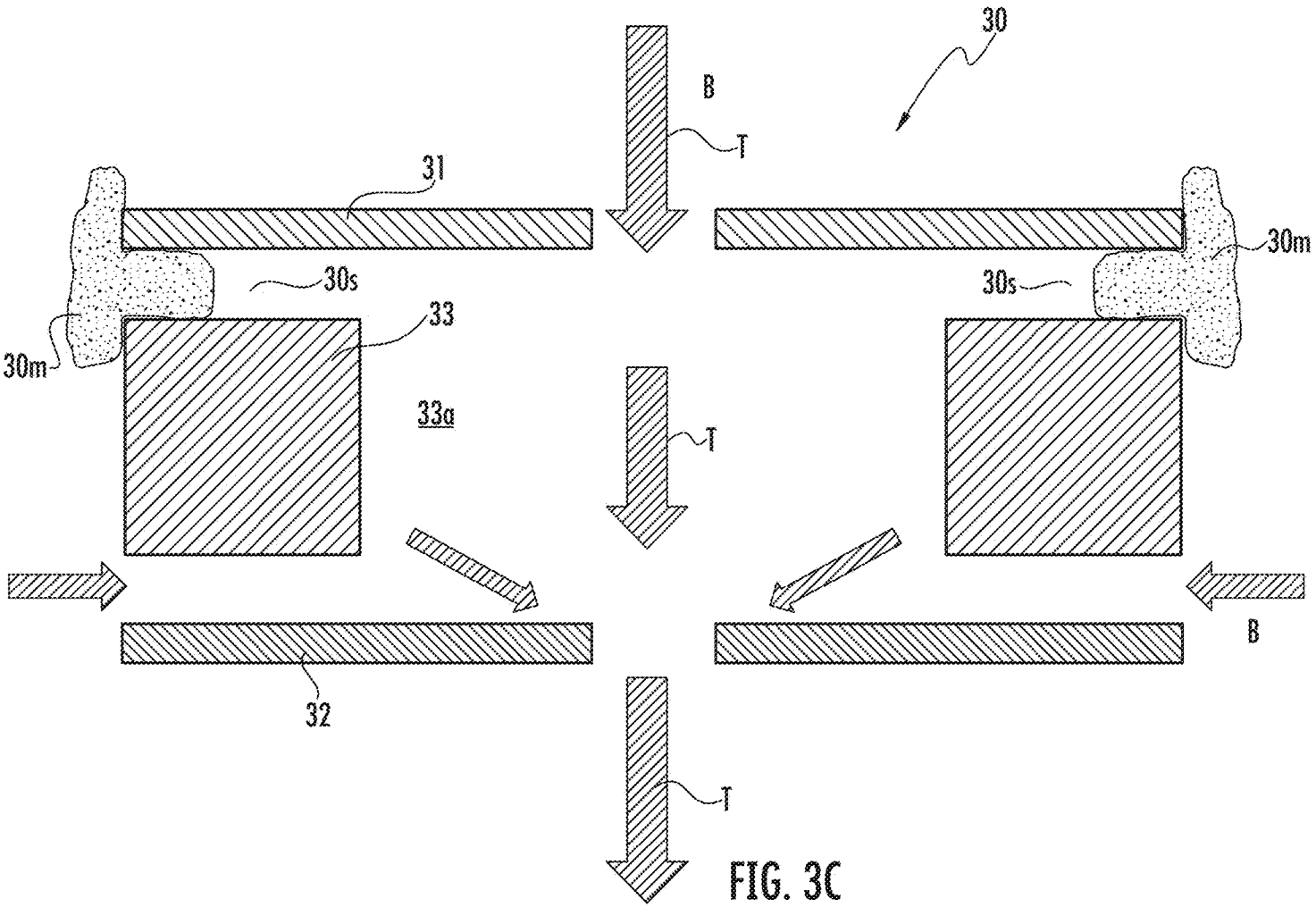
FIG. 3C is a schematic enlarged illustration of a sealed ion trap according to embodiments of the present invention.
Figure 3D:
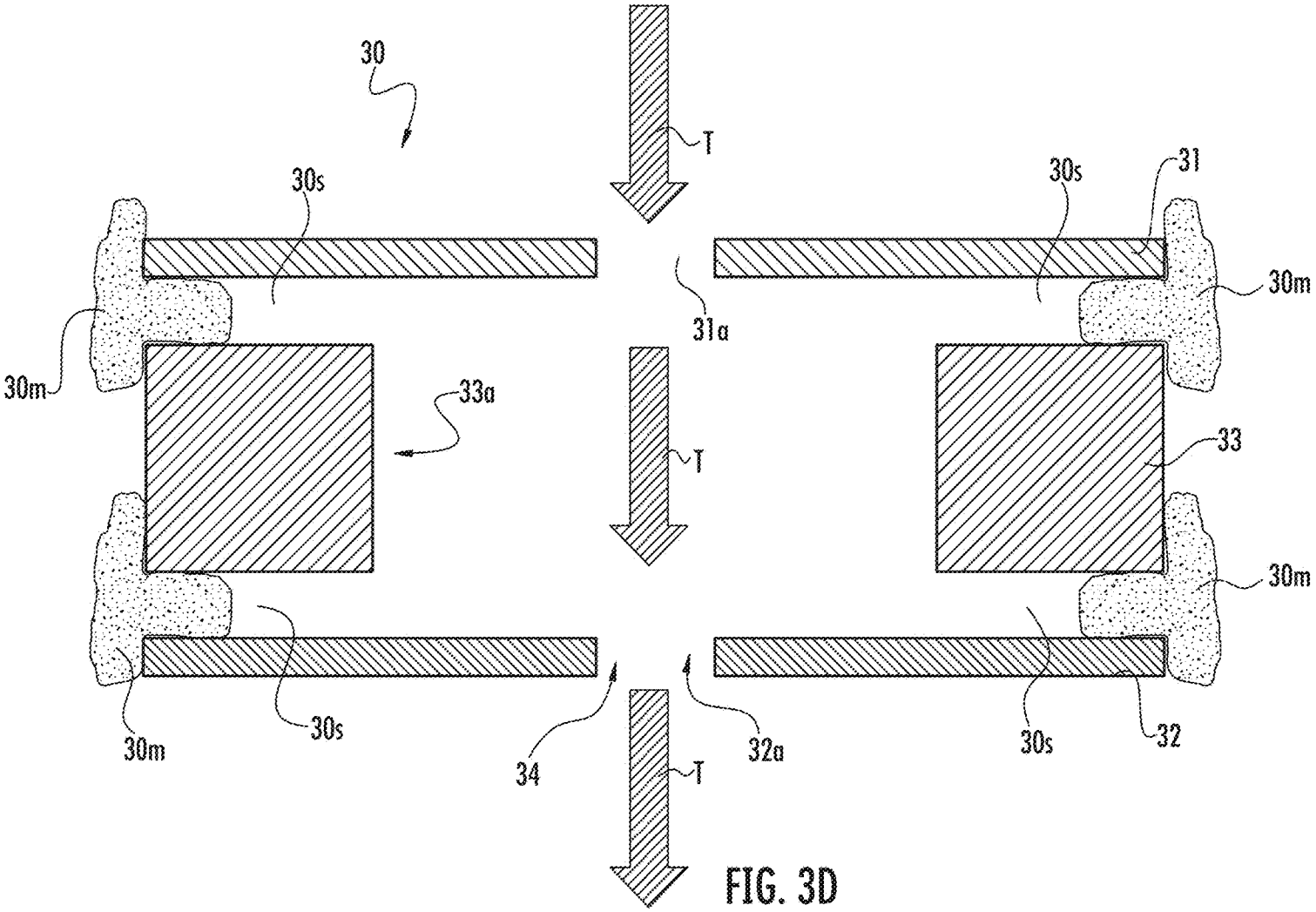
FIG. 3D is a schematic illustration of another embodiment of a sealed ion trap according to embodiments of the present invention.

FIGS. 3B-3D illustrate examples of ion traps 30 which include at least one sealed space 30*s* between the ring electrode 33 and at least one of three endcap electrodes 31, 32 so that incoming buffer gas B is restricted, attenuated or blocked, so that buffer gas B does not enter this space or so that incoming buffer gas B entering from these perimeter spaces is greatly reduced (typically by at least 40% or 50%) relative to unsealed configurations of the ion trap 30. The sealed space 30*s* with the sealant 30*m* for the trap electrodes can be configured to shunt 60-70% of buffer gas B to increase flow through the ring electrode 33 relative to an unsealed state. In some embodiments, the sealed state can be such that buffer gas entering through the perimeter spaces is only between about 0%-10% of that relative to an unsealed configuration. The term "incoming" refers to buffer gas that enters the ion trap from outside a boundary of the ion trap itself. All or substantially all buffer gas B flow/transport flows through the ring electrode 33 and out of the endcap apertures 32*a*. Thus, the outgoing gas flow T is axially out of the ion trap aligned apertures 33*a*, 32*a*.

As shown in FIG. 3B, at least a perimeter portion of the ejector endcap 32 is sealably attached to a perimeter portion of a primary surface of the ring electrode 33 with a sealant 30*m* to block buffer gas B from entering the sealed perimeter space between the ejector endcap 32 and the ring electrode 33. The broken line shading of the sealant 30*m* indicates that the sealant 30*m* can extend inward a distance to reside adjacent to and surround the ring electrode aperture(s) 33*a*. FIG. 3C illustrates that the injector endcap 31 is sealably attached to the ring electrode 33. In either case, it is contemplated that gas flow/transport T, and therefore signal enhancement, can be improved due to a restricted intake of buffer gas B.

FIG. 3D illustrates a fully sealed trap that seals both endcap electrodes 31, 32 to the respective ring electrode 33 (with sealant on or facing opposing primary surfaces of the ring electrode) and allows buffer gas B entry primarily, only, or substantially only, through the axially extending apertures 31*a* of the inlet/injector endcap electrode 31, then through the ring electrode aperture(s) 33*a*, and out the ejector endcap electrode apertures 32*a*. The sealant 30*m* can comprise an electrically insulating, gas impermeable material and/or sealant member. The sealant 30*m* can extend from an outer perimeter portion inward a distance, orthogonal to the plane of axial gas flow and/or transport T, to reside adjacent to and surround the ring electrode aperture(s) 33*a*.

The sealant 30*m* forming the sealed space 30*s* can comprise one or more of a electrically insulating, gas impermeable plug, washer, gasket, RF putty, or other suitable material. The sealant 30*m* may be used with insulating spacers or layers 201 (FIG. 6A, 6B) separating the ring electrode 33 from a respective endcap electrode. In some embodiments, the sealant 30*m* may also form or define the electrical insulator between electrodes 31 and 33 and/or 33 and 32.

Figure 3E:
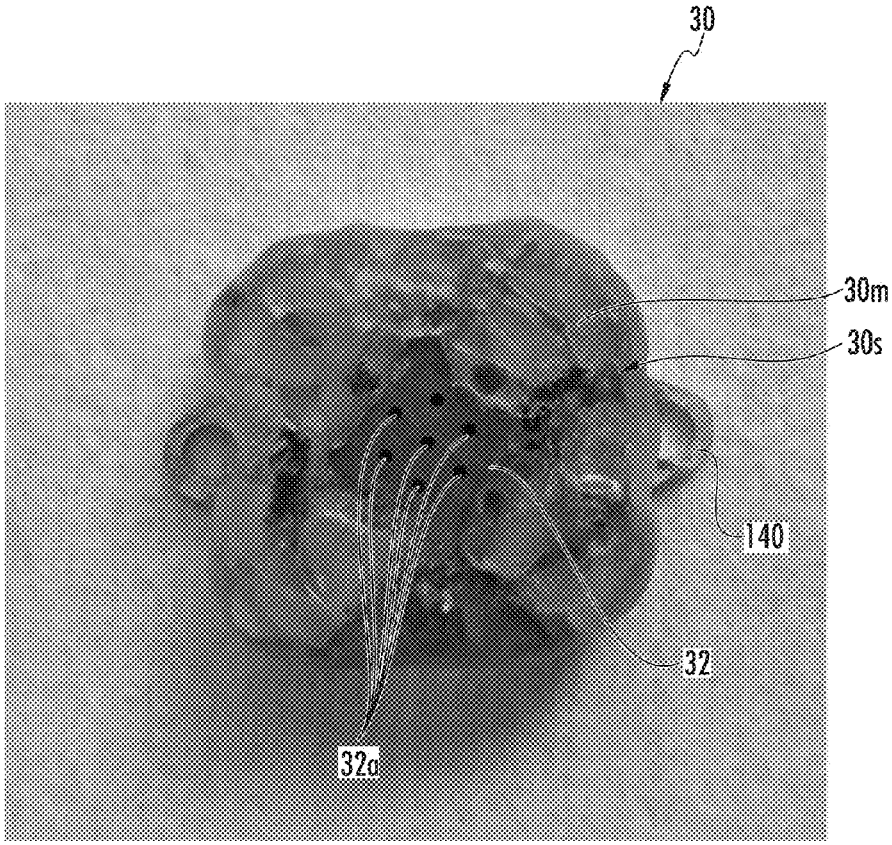
FIG. 3E is a digital photograph of a top view of a sealed ion trap according to embodiments of the present invention.

FIG. 3E illustrates an example of an ion trap 30 with a sealant 30*m* over the the endcap electrode 32 leaving trap apertures 32*a* exposed but the perimeter sealed. In this example, an RF putty was used as the sealant 30*m*. The RF putty can comprise a silicone rubber compound with suitable electrical insulating characteristics. In some embodiments, the RF putty will never harden or shrink, even in vacuum environments, and has good adhesive properties. An example of a suitable RF putty is GC Electronics 10-8880 from Allied Electronics.com. The dielectric strength can be about 550 Volts/Mil, but may have other ranges/values.

The mass spectrometer 10 can be configured to operate with substantially continuous convective gas flow through the mass analyzer over a suitable operational period of days, weeks or months, for example.

The spectrometer 10 can include a buffer gas source B (FIG. 7A, for example) and the system can be configured to provide the buffer gas to the chamber 20A so that buffer gas/background pressure is at high pressure. The gas pressure P1 in the chamber 20A can be held substantially constant to be between about 50 mTorr to about 1000 Torr, typically between about 100 mTorr-10 Torr, for a time period extending over at least multiple successive mass resonance scans, e.g., during successive ionization, trappings and mass scans. In particular embodiments, the gas pressure P1 can be about 100 mTorr, about 150 mTorr, about 200 mTorr, about 250 mTorr, about 300 mTorr, about 350 mTorr, about 400 mTorr, about 450 mTorr, about 500 mTorr, about 550 mTorr, about 600 mTorr, about 650 mTorr, about 700 mTorr, about 750 mTorr, about 800 mTorr, about 850 mTorr, about 900 mTorr, about 950 mTorr, about 1 Torr, about 1.25 Torr, about 1.5 Torr, about 1.75 Torr, about 2 Torr, about 2.25 Torr, about 2.5 Torr, about 3 Torr, about 4 Torr, about 5 Torr, about 6 Torr, about 7 Torr, about 8 Torr, about 9 Torr, about 10 Torr, about 20 Torr, or even higher such as between about 30-1000 Torr, or any sub-range therebetween.

Figure 4A:
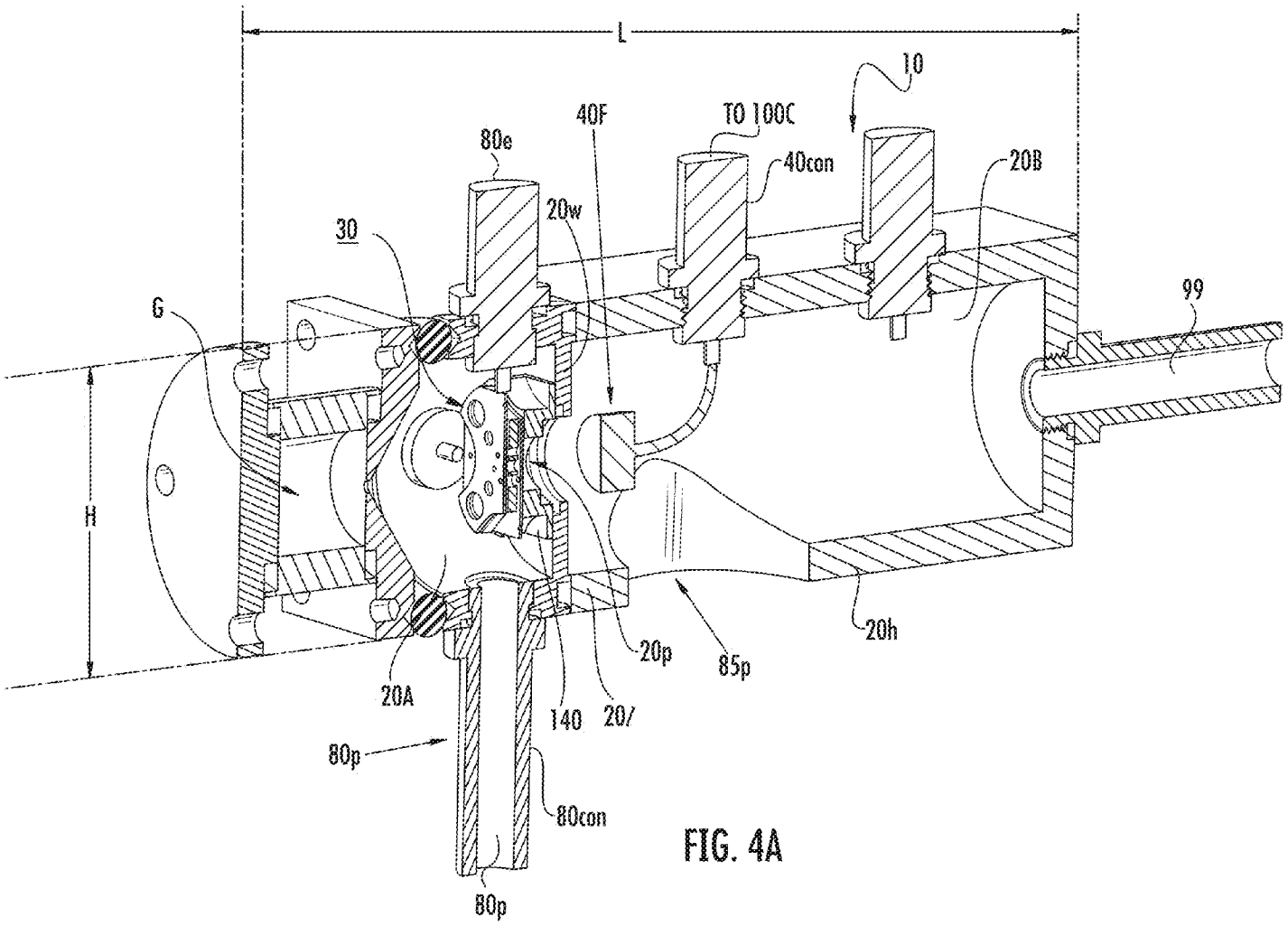
FIG. 4A is a partial, cutaway perspective view of a subassembly with an exemplary dual chamber configuration according to embodiments of the present invention.
Figure 4B:
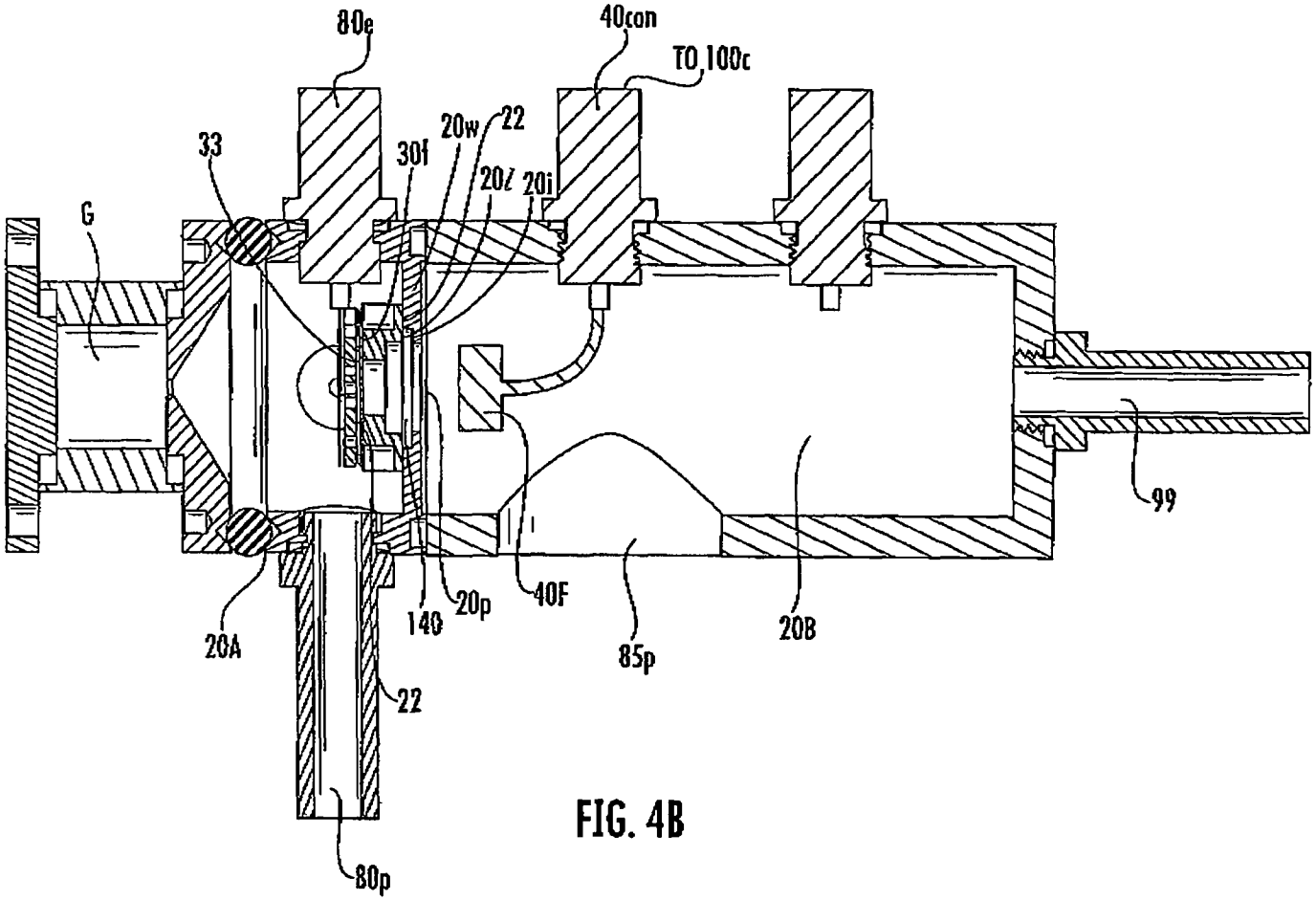
FIG. 4B is a side view of the subassembly shown in FIG. 4A according to embodiments of the present invention.
Figure 4C:
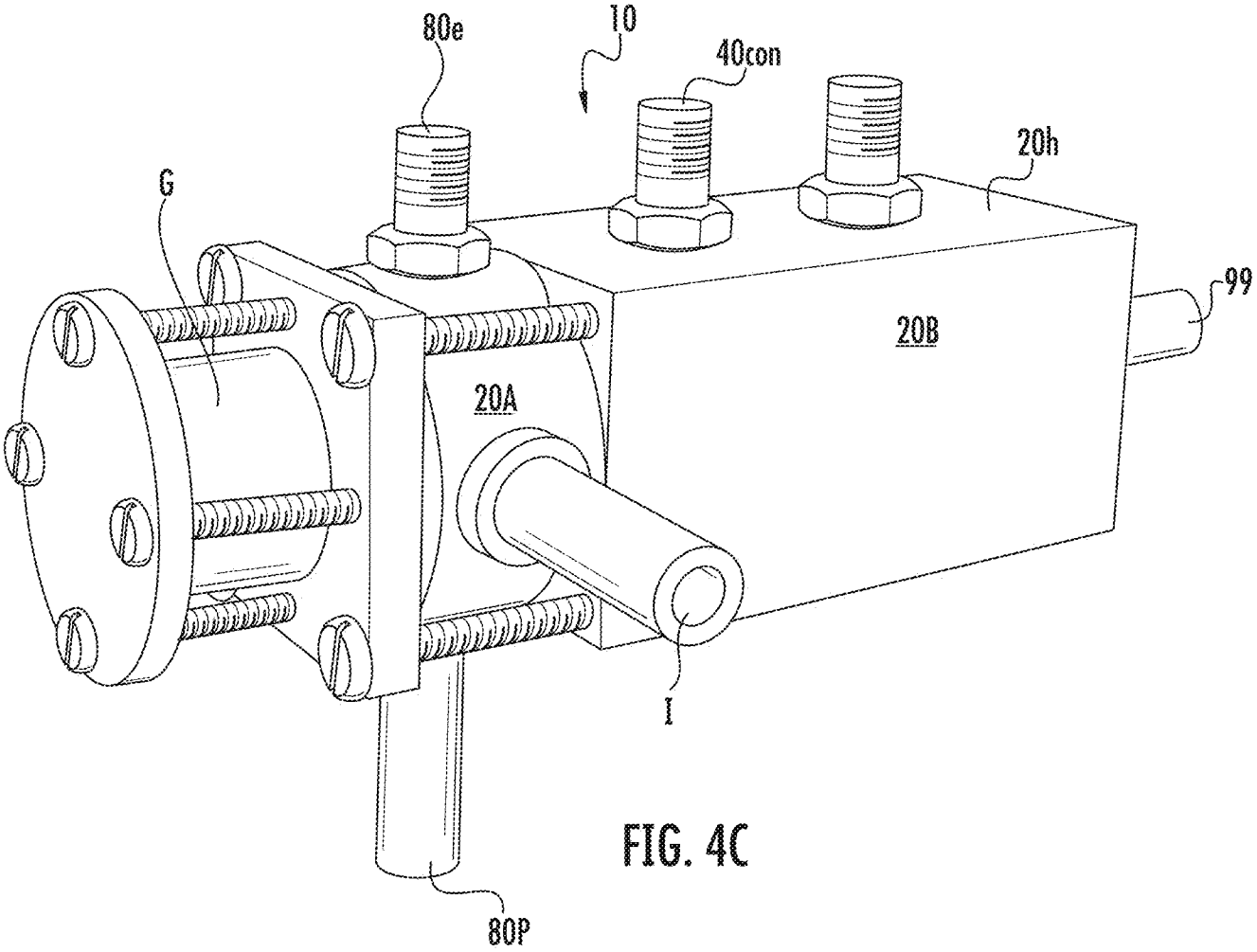
FIG. 4C is a side perspective view of an exemplary housing with dual (vacuum) chambers according to embodiments of the present invention.

FIGS. 4A-4C illustrate an example of a device body/housing 20*h* with the chambers 20A, 20B according to some embodiments of the invention. The device body 20*h* can hold a vacuum connector 80*con* for the vacuum port 80*p* for connection to the pump 80 for the first compartment/chamber 20A. The second compartment/chamber 20B has at least one vacuum pumping port 85*p* attached to a vacuum connector to connect to pump 85. The detector 40 resides in the second chamber/compartment 20B, aligned with the gas flow path exit 20P and is connected to leads that extend through the vacuum feed-through connector 40*con* to connect to the control circuit 100*c*.

A vacuum feed-through 99 can reside on one end of the chamber 20B, but can be located in other regions. In some optional embodiments, an SMA connector can be used as a plug and extension chamber to hold pressure in the chamber 20B.

A valve 85*v* (FIG. 2), such as an angle valve, between the chamber 20B and (turbo) pump 85 can be used to limit pump conductance during high-pressure operation/experiments. One or both chambers/compartments 20A, 20B can comprise a coaxial electrical feed-through (such as SMA coaxial connection such as, for example part number 901-9841 from Amphenol), shown as 80*e* in FIG. 4B), which can be used to couple low and high frequency signals into the (vacuum) chamber(s).

As shown in FIG. 4B, the mass analyzer (e.g., ion trap) 30 is sealably attached to wall 20*w* so that all buffer gas flow and/or analyte ion transport is conducted through the mass analyzer 30 from the ion source side 50 to the detector side 40. The forward facing surface of the mass analyzer 30*f* (detector facing side) may comprise a seal 22 that seals the ion trap mass analyzer 30 directly or indirectly (the latter in the embodiment shown) against the inner wall surface 20*i* of the first compartment 20A so that the ring or central electrode aperture(s) 33*a* aligns with the gas flow path aperture 20P. In the embodiment shown in FIGS. 4A and 4B, a mounting fixture 140 holds the ion trap 30 and the forward facing surface 30*f* of the ion trap can be sealed to the upstream side of the mounting fixture 140. The downstream side of the mounting fixture 140 can be mounted with a seal 22 to seal against an inner extending ledge 20*l*. The mounting fixture 140 and the ledge 20*l* can form the wall 20*w*. Thus, one or more sealants and/or seals 22 can be used to form a gas-tight interface. The sealants/seals can comprise one or more of vacuum grease, an electrically insulating, gas impermeable gasket or O-ring, RF putty and the like to provide a sealed, substantially leak-proof connection, between the two chambers 20A, 20B. The term "sealed" for this interface means that the mass analyzer 30 and/or subassembly 130*s* interface with a mounting fixture 140 and/or wall or partition 20*w* have a leak rate that is no more than 5%, typically no more than about 1% of the average gas flow out of the analyzer, e.g., for example, a leak rate that is no more than 0.01 sccm for an average 1 sccm flow.

FIGS. 2, 4A and 4B also illustrate that the housing 20*h* can hold a glow discharge G can be used as an electron (ion) source 50. Of course, other source configurations/devices may be used as is well known. FIGS. 4A and 4B illustrate that the detector 40 can include a Faraday cup 40C. The ions signal can be collected on a Faraday cup 40C and amplified by an amplifier 92 (FIG. 7A). One example of an amplifier 92 is the A250CF CoolFET® Charge Sensitive Preamplifier from Amptek Inc. Other detector configurations and other amplifiers may be used.

Still referring to FIGS. 4A-4C, the volumes in each chamber/compartment 20A, 20B can be the same or different. As shown, the first chamber external housing and/or internal chamber 20A can be cylindrical while the second chamber external housing and/or internal chamber 20B can be rectangular and held in abutting contact sealably attached to the first housing segment. Two rectangular shaped chambers 20A, 20B may be used, in some embodiments. Other shaped external and internal components may be used for the chambers 20A, 20B.

In some embodiments, the volume in the first compartment/chamber 20A is greater than that of the second compartment/chamber 20B by between about 10-40%. In other embodiments the volume in the first compartment/chamber 20A is less than that of the second compartment/chamber 20B by between about 10-40%. In some particular embodiments, each volume of the chamber or compartment 20A, 20B can be relatively small, such as between about 0.25 $in^3$ to about 16 $in^3$, typically between about 1 $in^3$ to about 10 $in^3$, such as about 1 $in^3$, about 2 $in^3$, about 3 $in^3$, about 4 $in^3$, about 5 $in^3$, about 6 $in^3$, about 7 $in^3$, about 8 $in^3$, about 9 $in^3$, about 10 $in^3$.

As shown in FIGS. 4A and 4B, for example, the chambers 20A, 20B can reside in a compact housing 20*h* having a length L and height (or width) dimension H. The length dimension L can be between about 1-5 inches, typically between about 1-3 inches, such as about 1 inch, about 1.5 inches, about 1.75 inches and about 1.85 inches, for example. The height/width dimension H can be between about 0.5 inches to about 5 inches, typically about 1 inch.

In some embodiments, the forward end of the ion trap 30 is closely spaced to be in close spatial proximity of the detector 40, which may be particularly advantageous for small mass spectrometry systems operating at high pressure (e.g., in some examples, approximately >1 Torr) due to the reduced mean free paths experienced by the ejected ions at such pressures. In some embodiments, the spacing D (FIG. 5A) is between about 0.01 inches (0.254 mm) to about 0.5 inches (13 mm), more typically between about 1 mm and about 10 mm.

Figure 5A:
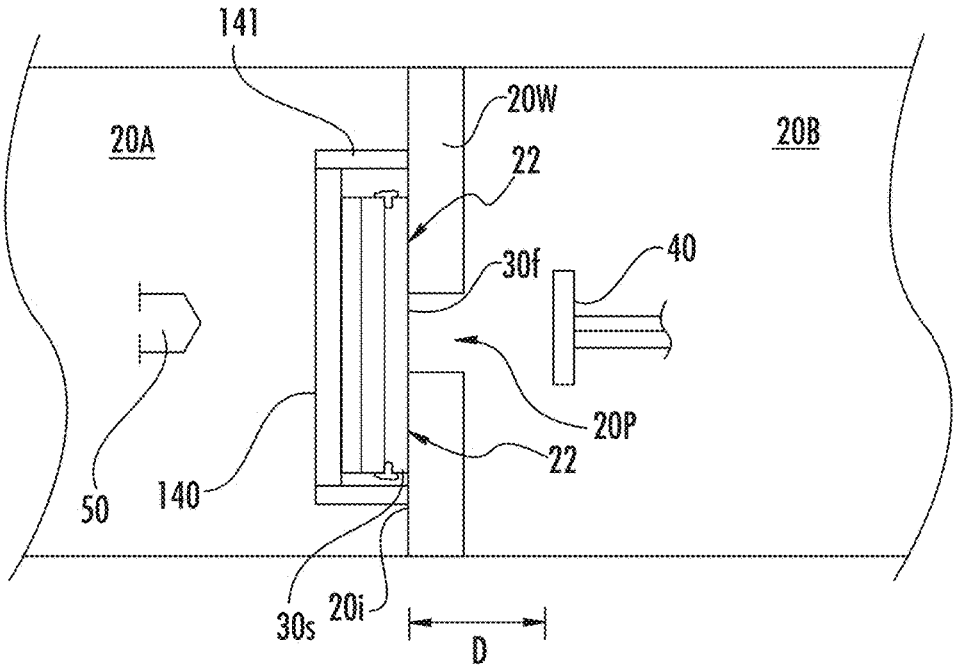
FIG. 5A is a side partial cutaway schematic illustration of a mass analyzer sealably attached to a member separating the chambers according to embodiments of the present invention.

As noted above, the ion trap 30 can be held by a mounting fixture 140. The subassembly 30*s* is typically oriented with the mounting fixture 140 sealably engaging a wall or ledge 20*l* in the housing 20*h* to form the wall or partition 20*w* as shown in FIGS. 4A and 4B. Alternatively, the mounting fixture 140 can be held in the reverse orientation so that the bottom of the assembly shown in FIG. 6A faces the ionizer 50 as shown in FIG. 5A, for example. Standoffs or legs 141 can be used to attach the ion trap 30 to the wall 20*w*. The seal 22 can be over the face of the endcap electrode, leaving apertures 32*a* open for flow through path 20P. Thus, for example, the wall 20*w* can be integrated with or attached to the housing 20*h* and the mounting fixture 140 is not required to form the partition or seal against the wall 20*w* or ledge 20*l* as shown in FIG. 5A. The mounting fixture 140 can provide a snug abutting contact of the forward end of the ion trap, e.g., the end cap ejector electrode 32 (or 31) against the inner wall surface 20*i*.

Figure 5B:
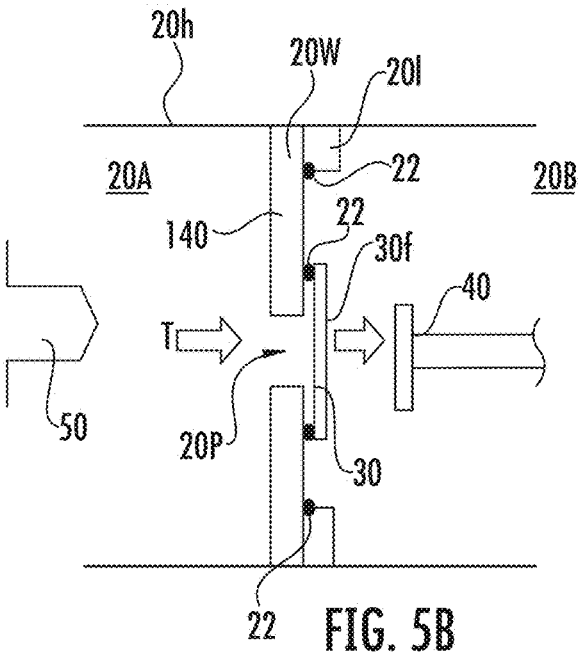
FIG. 5B is a side partial cutaway schematic illustration of a mass analyzer sealably attached to a member separating the chambers according to embodiments of the present invention.

FIG. 5B illustrates that the ion trap 30 can reside on the downstream side of the wall 20*w*, adjacent, typically abutting, the path 20P with or without the mounting fixture 140. As shown, the mounting fixture 140 can be used to hold the ion trap 30 against the inwardly extending ledges 20*l*; however, other mounting configurations and hardware may be used.

The ion trap endcap electrodes 31, 32, and ring electrode 33 can be sealably attached to each other to generate convective buffer gas flow with the gas transport to be primarily or substantially only through the ring electrode and ejector endcap. In some embodiments, the ion trap 30 can be mounted directly to the internal wall 20*w* without requiring a separate mounting fixture 140.

In some embodiments, the mass spectrometer system 100 can be configured with one or more ion traps 30 and/or the ion traps 30 can comprise more than one trapping cavity. In some embodiments, mass ejection from each of the cavities may be detected by a single detector 40 to produce a composite (combined enhanced) mass spectrometry signal. In some embodiments, the signal for detection may be based on outputs from a subset of different traps. In some embodiments, mass ejection from each or a subset or groups of cavities may be detected by separate detectors. This arrangement may be useful in cases where each cavity or groups (subsets) of cavities have different trapping properties. For example, an arrangement of this type may extend the range of ion masses that can be analyzed by the spectrometer system.

In some embodiments, a portable, light weight mass spectrometer 10 can be configured to have a plurality of the dual chamber devices 20*h* so as to concurrently sample multiple samples using a common or different detector or detectors In some embodiments, the mass spectrometer 10 comprises a microscale ion trap 30 configured to have a pressure P2 that is between about 90% to about 10% of P1.

In some embodiments, which may be particularly suitable for microscale ion traps, P2/P1 is less than 1, typically between 0.95 and 0.1, more typically between 0.9 and 0.5.

In some embodiments, for example, where P1 is about 1.77 Torr, P2 can be between about 1.70 Torr and about 17 mTorr, typically about 1.70 Torr and 0.5 Torr. In some embodiments, when P1 is about 1 Torr, P2 can be between about 10 mTorr to about 950 mTorr, typically between about 500 mTorr and 900 mTorr. In some embodiments, P2/P1 is between about 0.9 to about 0.5, such as 0.9, 0.85, 0.8, 0.75, 0.70, 0.65, 0.60, 0.65, 0.60, 0.55 and 0.50 and any value therebetween. Thus, where P1 is about 1 Torr, P2 is about 500 mTorr. Lower P2 pressures may be used relative to P1, but it has been found that further decreases of pressure P2 on the detector side does not increase peak signal intensity (m/z (Th)), at least for some buffer gases.

Figure 6B:
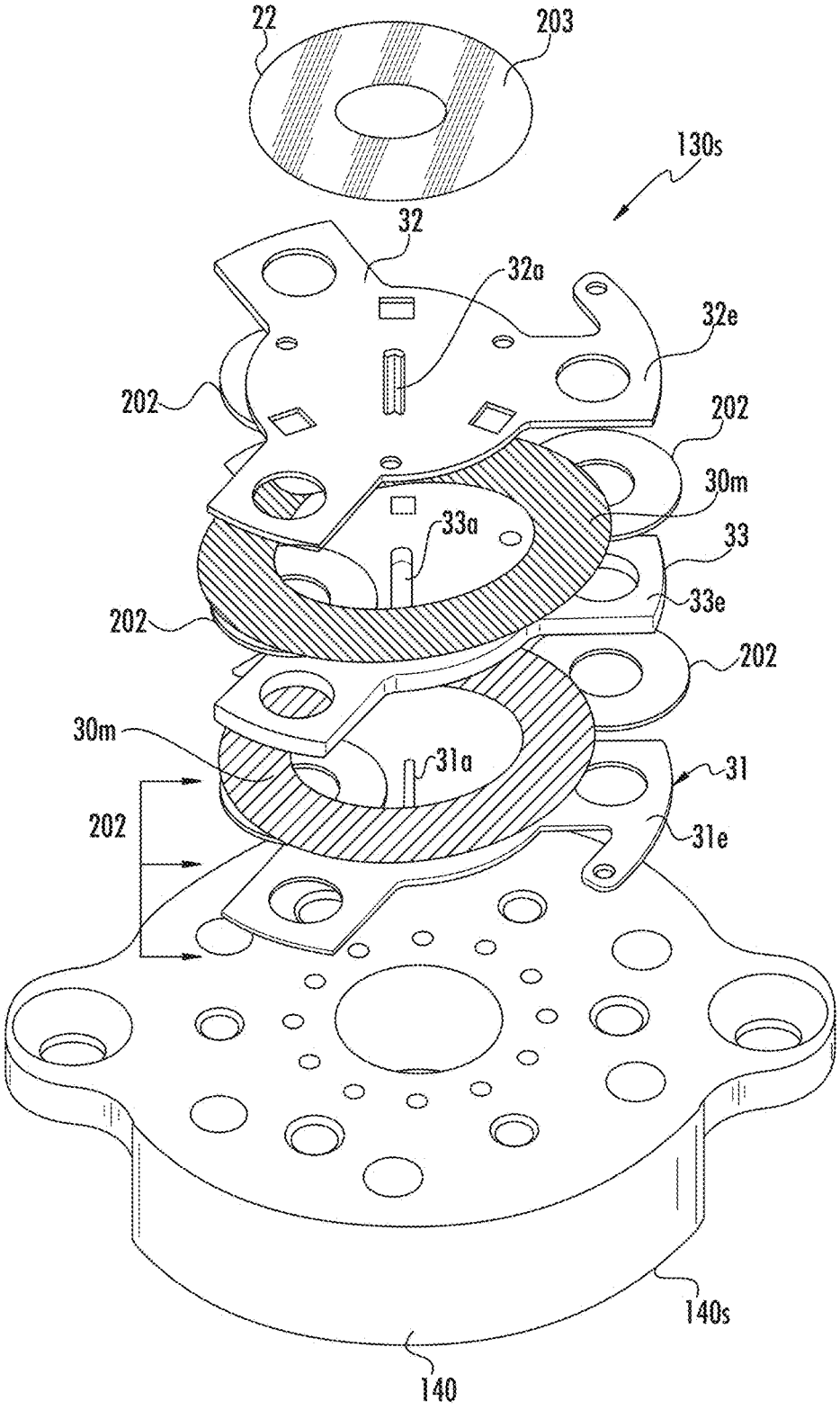
FIG. 6B is an exploded view of the subassembly shown in FIG. 6A.
Figure 6C:
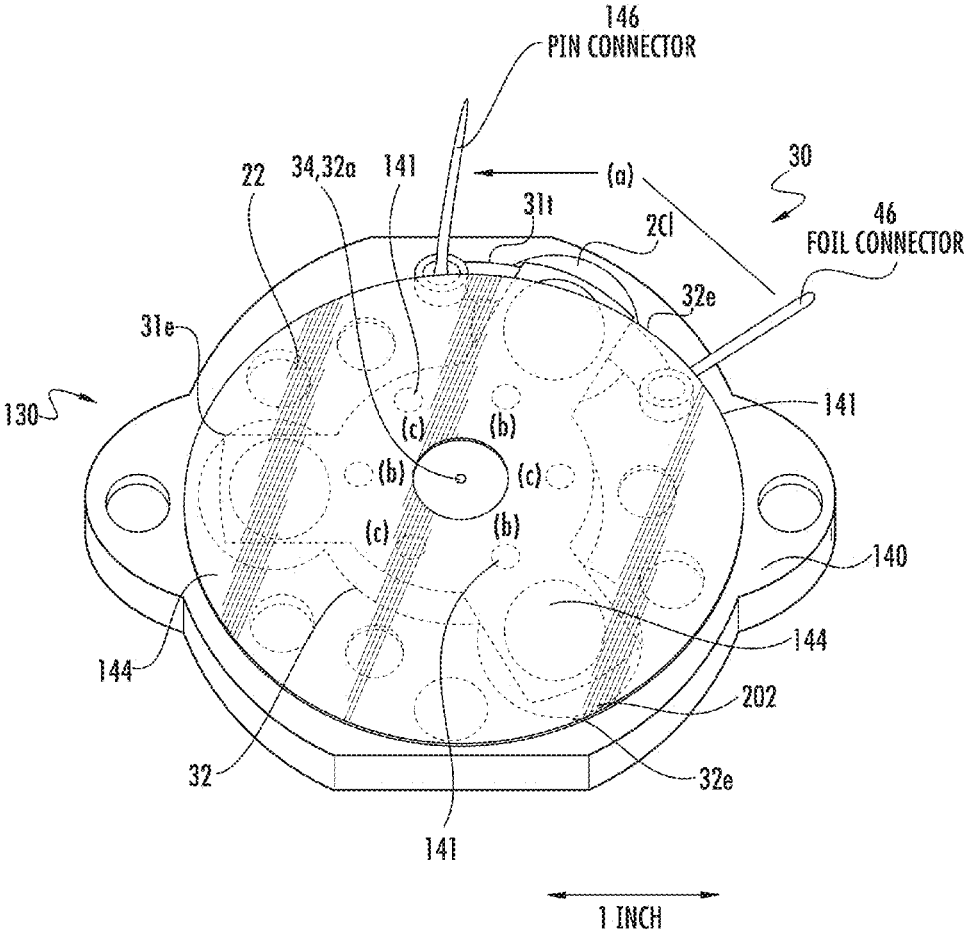
FIG. 6C is a top perspective view of another embodiment of a mass analyzer subassembly according to embodiments of the present invention.

FIGS. 6A-6C illustrate an example of a mass analyzer subassembly 130*s*. Aligned respective apertures 31*a*, 32*a*, 33*a* define a respective ion trap 34. The term "aperture array", means axially aligned apertures of the ion trap electrodes that have a distance "b" between centers of adjacent apertures. The apertures can be arranged in a regular pattern or random. As noted above, the ring electrode apertures 33*a* will generally be larger than the first or second end cap electrode apertures 32*a*, 31*a*. As is well known, a respective ion trap has a tubular channel of different diameters of aligned end cap and ring apertures. The end cap electrodes 31, 32 are spaced a distance d away from the ring electrode 33, typically in symmetric spacing. The specific spacing depends on the ring electrode thickness, but a distance spacing of the end cap electrodes 31, 32 can be chosen to optimize mass spectrometry performance. This distance is typically chosen such that $z_0$ is slightly larger than $r_0$, typically 10-30% larger. The end cap apertures or holes 31*a* allow the injection of ionization energy or ions and the other endcap apertures 32*a* allow for the ejection of ions for detection purposes.

The apertures 31*a*, 32*a*, 33*a* each have a radius $r_0$ or average effective radius (e.g., the latter calculates an average hole size using shape and width/height dimensions where non-circular aperture shapes are used) and the trap 34 has a corresponding diameter or average cross distance $2r_0$ and an effective length $2z_0$. The ion trap 34 can be configured to have a defined ratio of $z_0/r_0$ that is greater than 0.83. Note that $z_0$ can be defined as the half-height of the cavity, half height of the aperture 33*a* plus the distance from the aperture 33*a* to the end cap electrode 32. In some embodiments, the ion trap aperture array has an effective length $2z_0$ measured as the distance between interior surfaces of the end caps 31, 32. The array can be configured to have a defined ratio of $z_0/r_0$ that is near unity but is generally greater than unity by a few tens of percent (e.g., 110%-130%). The $r_0$ and $z_0$ dimensions can be between about 0.5 μm to about 1 cm, but for microscale mass spectrometry applications contemplated by certain embodiments of the invention, these dimensions are preferably 1 mm or less, down to about 0.5 μm. FIG. 6C illustrates a different shape of the ion trap apertures 31*a*, 32*a*, 33*a* relative to the SLIT configuration shown in FIGS. 6A and 6B. The ring electrode of the SLIT configuration can have an aperture which extends along a longitudinal direction and the central electrode surrounds the aperture in a lateral plane perpendicular to the longitudinal direction to define a transverse cavity for trapping charged particles. The aperture in the ring electrode is elongated in the lateral plane, having a ratio of a major dimension to a minor dimension that is greater than 1.5. The minor dimension can be less than 10 mm and/or the transverse cavity can have a vertical dimension $2z_0$ that is less than about 1 mm.

The spacing between electrodes 31, 32, 33 can be set with planar insulators 202 shown by way of example in FIG. 6B as insulating washers such as polyimide washers (McMaster-Carr). The insulators can comprise one or more of Teflon®, mylar, mica, insulating ceramics, polyimide, macor, kapton, $SiO_2$, $Si_3N_4$ and ambient (background) gas in the chamber 20A. The term "insulator" refers to an electrical insulator and can comprise a solid substrate, a mesh substrate, a patterned substrate with spatial elements removed, a thin film coating of a suitable material on a conductor surface, or a gas or even the sealant 30*m* with or without a gas gap between adjacent trap electrodes.

Referring to FIGS. 6A-6C, the ion trap 30 can include three mechanically attached and aligned stacked (metal) electrodes 31, 32, 33 separated by insulators 201. For further discussion of exemplary CIT configurations, see U.S. Pat. No. 6,933,498, and U.S. Pat. No. 6,469,298, the contents of which are hereby incorporated by reference as if recited in full herein. An example of a single electrode ionizer is described in Kornienko, Anal. Chem. 2000, 72, 559-562 and Kornienko, *Rapid Commun. Mass Spectrom.* 1999, 13, 50-53, the contents of which are hereby incorporated by reference as if recited in full herein.

As shown in FIGS. 6A and 6B, an electrically insulating, gas impermeable sealant 30*m*, which may optionally comprise gasket 203, can be used to form a suitable leak-tight or leak-resistant seal space 30*s* for the ring electrode 33 and at least one of the endcap electrodes (e.g., the ejector and/or the injector electrode). As is shown in FIGS. 6A and 6B, an electrically insulating, gas impermeable sealant 22 can also be used to form an interface seal for the pathway 20P of the wall 20*w*, depending on the orientation of use for the subassembly 130*s* (compare, for example, FIGS. 4A, 4B with FIG. 5A). The sealant 22 can comprise a gasket 203 configured to form a vacuum seal against the inner surface of the chamber wall 20*w* with the end cap hole or holes 34 aligned with pathway 20P thereby providing a one-way gas transport arrangement for a convective flow of buffer gas between chambers 20A, 20B. If the mounting fixture 140 is held facing the detector 40, then a suitable sealant can be placed between the outer surface of the mounting fixture 140*s*, and also a seal such as a gasket 203 can be positioned between the upper surface of the mounting fixture and the adjacent end cap 31. The seal 22 may be provided by one or more of O-rings, vacuum grease, RF putty, gaskets, and the like or combinations of these or other known sealant materials and sealant devices.

The electrodes 31, 32, 33 can have a plurality of, typically three, circumferentially spaced apart ears 31*e*. Nylon screws 144 can be used to attach the components of the ion trap 30. However, it is also contemplated that the electrode and insulator components can be bonded or otherwise integrated into a unit.

Solder tabs 31*t*, 32*t* protruding from the electrodes 31, 32 (and 33) can provide convenient electrical connections to the ion trap 30. Pin connectors 146 can be attached (e.g., adhesively attached, soldered or brazed) to the electrode tabs 31*e* for easy trap modification or removal. A plurality of circumferentially spaced apart alignment apertures 149 on each of the electrodes 31, 32, 33 can accept alignment pins. The alignment apertures can be small, typically between about 0.1-2 mm, e.g., about a 1 mm diameter hole. The alignment apertures 149 can be used for accurate alignment of the electrodes 31, 32, 33 using correspondingly sized pins, e.g., for 1 mm apertures, about 1 mm diameter pins.

In some embodiments, a plurality (e.g., 3-6), shown as three, circumferentially spaced apart neighboring holes can have concentric features of decreasing diameter size for allowing measurement of electrode alignment, typically under a microscope. This allows for rapid verification of trap alignment prior to installation in the spectrometer housing. The end cap hole 32*a* of the single ion trap (CIT) 34 is visible in the center of the top electrode 32 in FIG. 6C. As discussed above, a sealant 30*m* or 22 may reside over the perimeter portion of the electrode 32, such as also shown in FIG. 3D.

In some embodiments, the ionization source 50, a mass analyzer 30 (such as, but not limited to, an ion trap mass analyzer), and the detector 40 can all be arranged as a releasably attached set or integrally attached unit of stacked planar conductor and insulator components, e.g., typically alternating conductive and insulating films, substrates, sheets, plates and/or layers or combinations thereof, with defined features for the desired function. See, e.g., co-pending, co-assigned U.S. patent application Ser. No. 13/804,911, the contents of which are hereby incorporated by reference as if recited in full herein.

The ionizer can be any suitable ionizer as is known to those of skill in the art. Array ionizers may also be used. Examples of types of ionization that can be provided in array form include, but are not limited to, cold field electron emitters, miniature gas plasma sources, and field ionization. Applying an appropriate magnitude electrical potential between the two conducting electrodes 31, 32 can generate electric field strengths to affect cold field emission of electrons, formation of a gas plasma, or field ionization of molecules or atoms. The close spatial proximity of the ionization array of the ion trap 30, may be particularly advantageous for small mass spectrometry systems operating at high pressure (approximately >1 Torr) due to the reduced mean free paths experienced by the ions or electrons at such pressures.

It is well known that ion traps 30 generate mass spectral information by ejecting an ensemble of trapped ions in an orderly fashion such that ions of a given mass to charge range are ejected through the end cap holes 32*a* during a defined or selected time period. Thus, the detector 40 comprises an appropriate transducer. The transducer typically comprises an electron multiplier but may be a planar detector 40 and, in particular embodiments, as shown in FIG. 4A, the detector 40 comprises a Faraday cup configuration. However, other detectors may be used.

Charge detection provided by a planar detector 40 may be particularly attractive for small mass spectrometry systems due to their inherently small size and weight and the ability to operate at pressures from low vacuum to atmospheric pressure. Charges collected by a conductive film or other conductor associated with the detector 40 can be measured either with an electrometer or a charge sensitive transimpedance amplifier. The term "electronic collector" refers to an electronic circuit that can detect charges collected by the film and/or conductor.

For example, the detector 40 can be configured to detect ions ejected in parallel from a planar CIT array with a planar electrode with a solid continuous conductive surface over the holes of the end cap electrode 32*a*. The gain of a charge sensitive transimpedance amplifier 92 (FIG. 7A) may be improved with reduced Faraday cup capacitance.

In some embodiments, the housing 100*h* can releasably attach a canister of pressurized buffer gas "B" that connects to a flow path into the (vacuum) chamber 20A. The housing 100*h* can hold a control circuit 100*c* and various power supplies 84, 86 that connect to components/conductors to carry out the ionization, mass analysis and detection. The housing 100*h* can hold one or more amplifiers including an output amplifier 92 that connects to a processor 100*p* for generating the mass spectra output.

The portable and/or compact system 100 can be lightweight, typically between about 1-15 pounds (including a vacuum pump or pumps), where used. The housing 100*h* can be configured as a handheld housing (FIG. 10B), such as having a form factor similar in size and weight as a Microsoft® Xbox®, Sony® PLAYSTATION® or Nintendo® Wii® game console or game controller, or similar to a form factor associated with an electronic notebook, PDA, IPAD or smartphone and may optionally have a pistol grip. However, other configurations of the housing may be used as well as other arrangements of the control circuit. The housing 100*h* typically holds a display screen 90 and can have a User Interface 91 such as a Graphic User Interface.

The system 100 may also include a transceiver, GPS module and antenna and can be configured to communicate with a smartphone or other pervasive computing device (laptop, electronic notebook, PDA, IPAD, and the like) to transfer data or for control of operation, e.g., with a secure APP or other wireless programmable communication protocol.

The system 100 can be configured to operate at pressures at or greater than about 100 mTorr up to atmospheric.

In some embodiments, the mass spectrometer 100 is configured so that the ion source (ionizer) 50, mass analyzer 30 and detector 40 operate at near isobaric conditions and at a pressure that is greater than 100 mTorr. The term "near isobaric conditions" includes those in which the pressure between any two adjacent chambers differs by no more than a factor of 100, but typically no more than a factor of 10. In some embodiments, the background pressures P1, P2 in respective chambers 20A and 20B define the pressure ratio P2/P1 to be $0.1<P2/P1<1$.

Figure 7B:
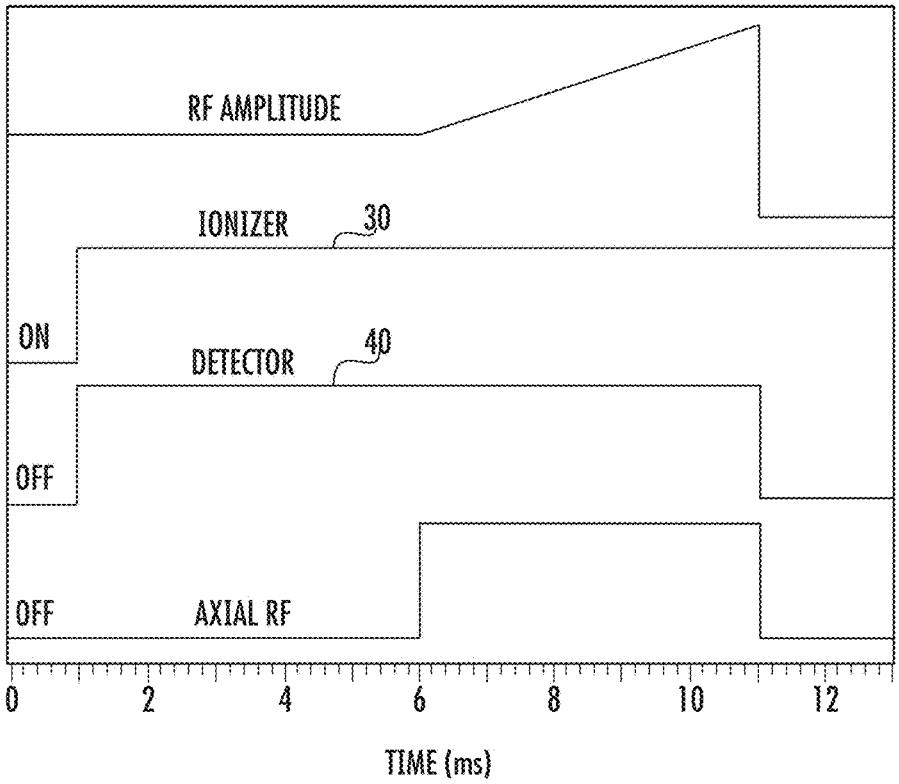
FIG. 7B is an exemplary timing diagram of a mass spectrometry system according to some embodiments of the present invention.

As shown in FIG. 7B, the spectrometer 100 can include an arbitrary function generator 82 to provide a low voltage axial RF input 82*i* to the ion trap 30 during mass scan for resonance ejection. The low voltage axial RF can be between about 100 mVpp to about 8000 mVpp, typically between 200 to 2000 mVpp. The axial RF can be applied to an end cap 31 or 32, typically end cap 31, or between the two end caps 31 and 32 during a mass scan for facilitating resonance ejection.

As shown in FIG. 7A, the device 100 includes an RF power source 70 that provides an input signal to the ring electrode 33. The RF source 70 can include an RF signal generator 70, RF amplifier 72 and RF power amplifier 74. The circuit may include an optional RF monitor 76. Some or all of these components can be held on a circuit board in the housing 100*h* enclosing the ion trap 30 in the chamber or sub-chamber 20A. In some embodiments, an amplitude ramp waveform can be provided as an input to the RF signal generator to modulate the RF amplitude. The low voltage RF can be amplified by a RF preamplifier then a power amplifier to produce a desired RF signal. The RF signal can be between about 1 MHz to 10 GHz, typically 1 MHz to 1000 MHz depending on the size of the ring electrode features. As is well known to those of skill in the art, the RF frequency depends reciprocally on the ring electrode radius, $r_0$. A typical RF frequency for an $r_0$ of 500 μm would be 5-20 MHz. The voltages can be between 100 $V_{0p}$ to about 1500

$V_{0p}$, typically up to about 500 $V_{0p}$ (as is well known to those of skill in the art, the "$_{0p}$" subscript refers to zero-to-peak).

Generally stated, electrons are generated in a well-known manner by source 50 and are directed towards the mass analyzer (e.g., ion trap) 30 by an accelerating potential. Electrons ionize sample gas S in the mass analyzer 30. For ion trap configurations, RF trapping and ejecting circuitry is coupled to the mass analyzer 30 to create alternating electric fields within ion trap 30 to first trap and then eject ions in a manner proportional to the mass to charge ratio of the ions. The ion trap 30 with the spectrometer housing 20*h* generating differential pressure can generate the convective buffer gas flow through the ring electrode and ejector endcap in the viscous or transitional flow regime to the detector side of the chamber or sub-chamber 20B.

The ion detector 40 registers the number of ions emitted at different time intervals that correspond to particular ion masses to perform mass spectrometric chemical analysis. The ion trap dynamically traps ions from a measurement sample using a dynamic electric field generated by an RF drive signal 75*s*. The ions are selectively ejected corresponding to their mass-to-charge ratio (mass (m)/charge (z)) by changing the characteristics (amplitude, frequency, etc.) of the trapping radio frequency (RF) electric field. Relative ion abundances (e.g., ion numbers) at particular m/z ratios can be digitized for analysis and can be displayed as spectra on an onboard and/or remote processor 100*p*. The signal can be enhanced using the convective buffer gas flow and/or differential pressure at the Kn number range noted above.

In the simplest form, a signal of constant RF frequency can be applied to the center electrode 33 relative to the two end cap electrodes 31, 32. The amplitude of the center electrode signal can be ramped up linearly in order to selectively destabilize different m/z of ions held within the ion trap. This amplitude ejection configuration may not result in optimal performance or resolution. However, this amplitude ejection method may be improved upon by applying a second signal differentially across the end caps 31, 32. This axial RF signal, where used, causes a dipole axial excitation that can result in the resonant ejection of ions from the ion trap when the ions' secular frequency of oscillation within the trap matches the end cap excitation frequency.

The ion trap 30 or mass filter can have an equivalent circuit that appears as a nearly pure capacitance. The amplitude of the voltage to drive the ion trap 30 may be high (e.g., 100 V-1500 Volts) and can employ a transformer coupling to generate the high voltage. The inductance of the transformer secondary and the capacitance of the ion trap can form a parallel tank circuit. Driving this circuit at resonant frequency may be desired to avoid unnecessary losses and/or an increase in circuit size.

Sample S may be introduced into the chamber 20A with a buffer gas B through an input port I toward the ion trap 30. The S intake from the environment into the housing 100*h* can be at any suitable location (shown by way of example only from the bottom). One or more sample intake ports can be used.

The buffer gas B can be provided as a pressurized canister 110 of buffer gas as the source. However, any suitable buffer gas or buffer gas mixture including air, helium, hydrogen, or other gas can be used. Where air is used, it can be pulled from atmosphere and no pressurized canister or other source is required. Typically, the buffer gas comprises helium, typically above about 90% helium in suitable purity (e.g., 99% or above) or suitably pure nitrogen. A mass flow controller (MFC) 122 (FIG. 7A) and/or inlet valve 83*v* (FIG. 2) can be used to control the flow of pressurized buffer gas B from pressurized buffer gas source with the sample S into the chamber 20A. When using ambient air as the buffer gas, a controlled leak can be used to inject air buffer gas and environmental sample into the vacuum chamber. The controlled leak design can depend on the performance of the pump utilized and the operating pressure desired.

FIG. 7B illustrates an exemplary timing diagram that can be used to carry out/control various components of the mass spectrometer 100. The drive RF amplitude signal can be driven using a ramp waveform that modulates the RF amplitude throughout the mass scan and the other three pulses control ionization, detection and axial RF voltages applied. As shown, initially, 0 V can optionally be applied to a gate lens (where used) to allow electrons to pass through during the ionization period. Alternatively, this signal can be applied to the ionizer 30 directly to turn on and off the production of electrons or ions. The drive RF amplitude can be held at a fixed voltage during an ionization period to trap ions generated inside the trap 30. At the end of the ionization period, the gate lens voltage (if used) is driven to a potential to block the electron beam of the ionizer 30 and stop ionization. The drive RF amplitude can then be held constant for a defined time, e.g., about 5 ms, to allow trapped ions to collisionally cool towards the center of the trap. The drive RF amplitude can be linearly ramped to perform a mass instability scan and eject ions toward the detector 40 in order of increasing m/z. The axial RF signal can be synched to be applied with the start of ramp up of the RF amplitude signal linear ramp up (shown at t=6 ms, but other times may be used) so as to be substantially simultaneously gated on to perform resonance ejection during the mass scan for improved resolution and mass range. Data is acquired during the mass instability scan to produce a mass spectrum and the convective buffer gas flow with ion transport can enhance the signal for detection. Finally, the drive RF amplitude can be reduced to a low voltage to clear any remaining ions from the trap 30 and prepare it for the next scan. A number of ion manipulation strategies can be applied to ion trap devices such as CITs, as is well known to those trained in the art. Different strategies to eject, isolate, or collisionally dissociate ions can be applied to the ion trapping structures.

Figure 8:
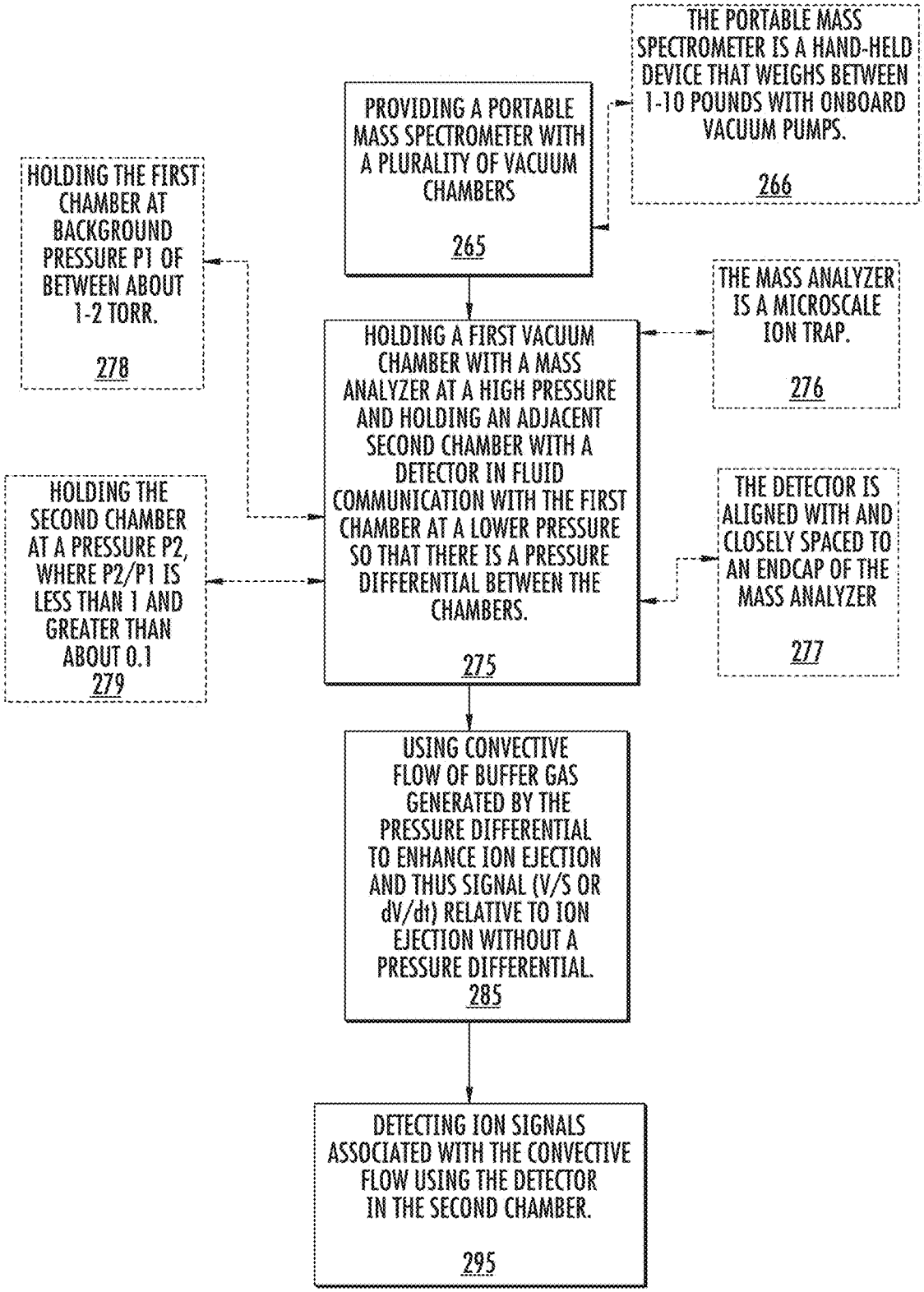
FIG. 8 is a flow chart of operations that can be used to operate a mass spectrometry system according to embodiments of the present invention.

FIG. 8 is a block diagram of operation of a mass spectrometer according to embodiments of the present invention. A portable mass spectrometer with a plurality of chambers (or sub-chambers) is provided (block 265). A first chamber with a mass analyzer can be held at a high background pressure and an adjacent second chamber with a detector in fluid communication with the first chamber can be held at a lower background pressure so that there is a pressure differential between the chambers (block 275). Convective flow of buffer gas generated by the pressure differential is used to enhance ion ejection, and thus enhance detected signal (V/s or dV/dt) relative to ion ejection without a (suitable) pressure differential (block 285). Ion signals associated with the convective flow of buffer gas to transport ions are detected using the detector in the second chamber (block 295).

The portable mass spectrometer can be a hand-held device that weighs between 1-10 pounds with onboard vacuum pumps (block 266).

The mass analyzer can be a microscale ion trap (block 276).

The detector can be aligned with and closely spaced to an end cap of the mass analyzer (block 277).

The first chamber can be held at a background pressure P1 of between about 1-2 Torr (block 278).

The second chamber can be held at a background pressure P2, where P2/P1 is less than 1 and about 0.1 or above (block 279). The pressure ratio P2/P1 can be one of 0.90, 0.85, 0.80, 0.75, 0.70, 0.65, 0.60, 0.55, 0.50, 0.45, 0.40, 0.35, 0.30, 0.25, 0.20, 0.15, and about 0.10.

One or more mass spectrometers 10, which may be high-resolution and/or high-sensitivity units, may be placed in or at a hazard site to analyze gases and remotely send back a report of conditions presenting danger to personnel. A mass spectrometer 10 may be placed at strategic positions on air or land transport to test the environment for hazardous gases that may be an indication of malfunction or even a terrorist threat. Embodiments of the present invention provide portable mass spectrometers suitable for handheld, field use.

Embodiments of the present invention may take the form of software and hardware aspects, all generally referred to herein as a "circuit" or "module."

As will be appreciated by one of skill in the art, features or embodiments of the present invention may be embodied as an apparatus, a method, data or signal processing system, or computer program product. Furthermore, certain embodiments of the present invention may include an Application Specific Integrated Circuit (ASIC) and/or computer program product on a computer-usable storage medium having computer-usable program code means embodied in the medium. Any suitable computer readable medium may be utilized including hard disks, CD-ROMs, optical storage devices, or magnetic storage devices. A processor can include one or more digital microprocessors.

The computer-usable or computer-readable medium may be, but is not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium, upon which the program is printed, as the program can be electronically captured, via, for instance, optical scanning of the paper or other medium, then compiled, interpreted or otherwise processed in a suitable manner if necessary, and then stored in a computer memory.

Computer program code for carrying out operations of the present invention may be written in an object oriented programming language such as Java7, Smalltalk, Python, Labview, C++, or VisualBasic. However, the computer program code for carrying out operations of the present invention may also be written in conventional procedural programming languages, such as the "C" programming language or even assembly language. The program code may execute entirely on the spectrometer computer and/or processor, partly on the spectrometer computer and/or processor, as a stand-alone software package, partly on the spectrometer computer and/or processor and partly on a remote computer, processor or server or entirely on the remote computer, processor and/or server. In the latter scenario, the remote computer, processor and/or server may be connected to the spectrometer computer and/or processor through a LAN or a WAN, or the connection may be made to an external computer, processor and/or server (for example, through the Internet using an Internet Service Provider).

The flowcharts and block diagrams of certain of the figures herein illustrate the architecture, functionality, and operation of possible implementations of mass spectrometers or assemblies thereof and/or programs according to the present invention. In this regard, each block in the flow charts or block diagrams represents a module, segment, operation, or portion of code, which comprises one or more executable instructions for implementing the specified logical function(s). It should also be noted that in some alternative implementations, the functions noted in the blocks might occur out of the order noted in the figures. For example, two blocks shown in succession may in fact be executed substantially concurrently or the blocks may sometimes be executed in the reverse order, depending upon the functionality involved.

The mass spectrometer 10 can include a circuit 100*c* with an onboard display 90 and/or one or more on-board processors 100*p* that direct the operation of the different component control signals. As shown in FIG. 7A, the mass spectrometer 10 can include a transmitter or transceiver 100*t* that allows it to wirelessly communicate with a local and/or remote processor and/or server using, for example, a LAN (local area network), WAN (wide area network), an intranet and/or the Internet. The mass spectrometer 10 can be configured to generate an audible and/or visual alert if an environmental, industrial or other hazard is detected. The circuit 100*c* can also or alternatively generate a local or remote alert when buffer gas is detected as being low or based on an assumed use rate/volume of the consumable input. The alert(s) may also be sent automatically via the Internet, WAN, LAN or the intranet to one or more local or remote sites for notification of a potential danger, for example. The alert can be sent to a cellular telephone, landline telephone, electronic notebook, electronic note pad or tablet, portable computer or other pervasive computing device.

The mass spectrometer 10 can include or communicate with an analysis module and/or circuit that can identify a substance by the obtained mass spectral information. The analysis module or circuit can be onboard or at least partially remote from the spectrometer device 10. If the latter, the analysis module or circuit can reside totally or partially on a server. The server can be provided using cloud computing which includes the provision of computational resources on demand via a computer network. The resources can be embodied as various infrastructure services (e.g. computer, storage, etc.) as well as applications, databases, file services, email, etc. In the traditional model of computing, both data and software are typically fully contained on the user's computer; in cloud computing, the user's computer may contain little software or data (perhaps an operating system and/or web browser), and may serve as little more than a display terminal for processes occurring on a network of external computers. A cloud computing service (or an aggregation of multiple cloud resources) may be generally referred to as the "Cloud". Cloud storage may include a model of networked computer data storage where data is stored on multiple virtual servers, rather than being hosted on one or more dedicated servers. Data transfer can be encrypted and can be done via the Internet using any appropriate firewalls, as suitable for the data collected.

Figure 9:
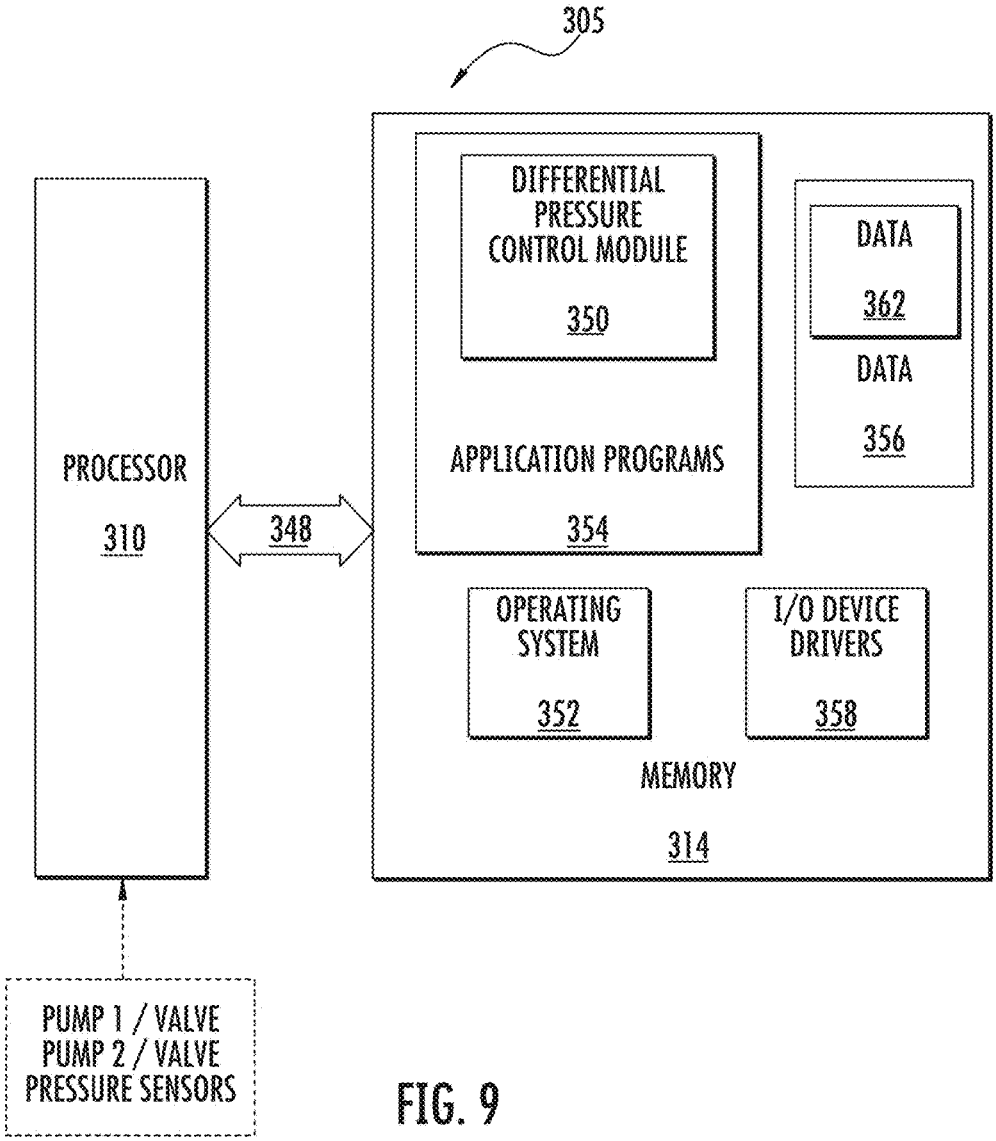
FIG. 9 is a block diagram of a data processing system according to embodiments of the present invention.

FIG. 9 is a block diagram of exemplary embodiments of data processing systems 305 that illustrates systems, methods, and computer program products in accordance with embodiments of the present invention. The processor 310 communicates with the memory 314 via an address/data bus 348. The processor 310 can be any commercially available or custom microprocessor. The processor 310 can be processor 100*p*. The memory 314 is representative of the overall hierarchy of memory devices containing the software and data used to implement the functionality of the data processing system 305. The memory 314 can include, but is not limited to, the following types of devices: cache, ROM, PROM, EPROM, EEPROM, flash memory, SRAM, and DRAM.

As shown in FIG. 9, the memory 314 may include several categories of software and data used in the data processing system 305: the operating system 352; the application programs 354; the input/output (I/O) device drivers 358; a Mass Spectrometer Differential Pressure Control Module 350; and the data 356. The Module 350 can be onboard the mass spectrometer or remote or partially onboard and partially remote (e.g., in one or more servers, local or onboard or remote processor 100*p*).

Figure 10A:
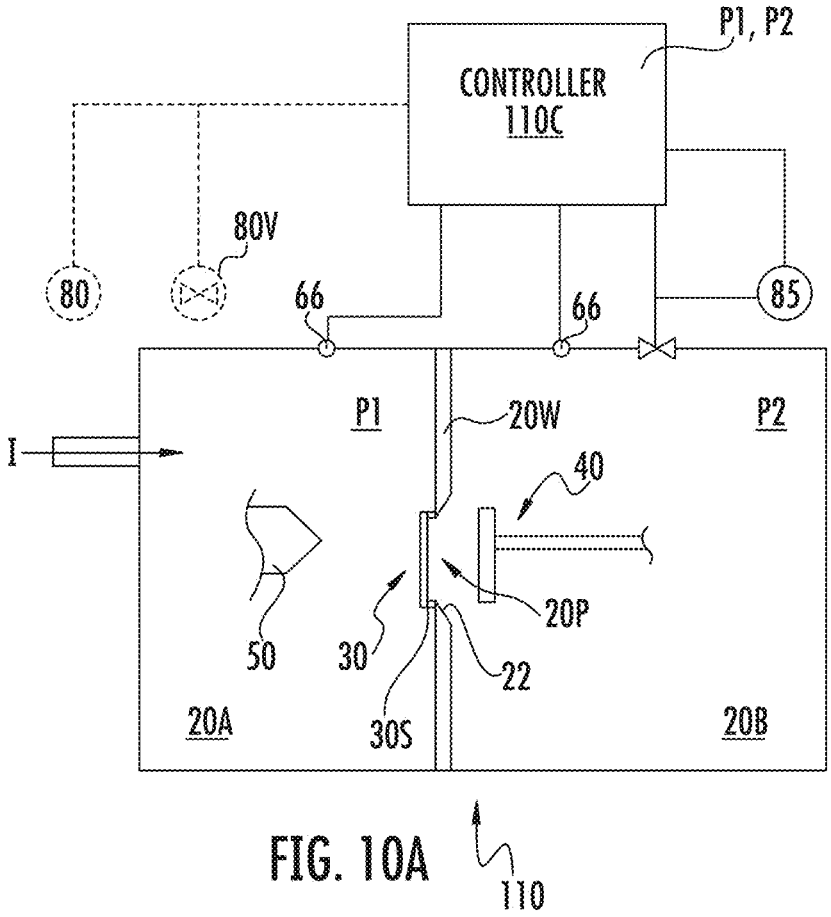
FIG. 10A is a schematic illustration of a differential pressure control circuit according to embodiments of the present invention.

The data 356 may include pressure data, which may be obtained from sensors 66 (FIG. 10A). As will be appreciated by those of skill in the art, the operating system 352 may be any operating system suitable for use with a data processing system, such as OS/2, AIX or OS/390 from International Business Machines Corporation, Armonk, N.Y., WindowsCE, WindowsNT, Windows95, Windows98, Windows2000 or WindowsXP from Microsoft Corporation, Redmond, Wash., PalmOS from Palm, Inc., MacOS from Apple Computer, UNIX, FreeBSD, or Linux, proprietary operating systems or dedicated operating systems, for example, for embedded data processing systems.

The I/O device drivers 358 typically include software routines accessed through the operating system 352 by the application programs 354 to communicate with devices such as I/O data port(s), data storage 356 and certain memory 314 components and/or the image acquisition system 320. The application programs 354 are illustrative of the programs that implement the various features of the data processing system 305 and can include at least one application, which supports operations according to embodiments of the present invention. Finally, the data 356 represents the static and dynamic data used by the application programs 354, the operating system 352, the I/O device drivers 358, and other software programs that may reside in the memory 314.

While the present invention is illustrated, for example, with reference to the Module 350 being an application program in FIG. 9, as will be appreciated by those of skill in the art, other configurations may also be utilized while still benefiting from the teachings of the present invention. For example, the Module 350 may also be incorporated into the operating system 352, the I/O device drivers 358 or other such logical division of the data processing system 305. Thus, the present invention should not be construed as limited to the configuration of FIG. 9, which is intended to encompass any configuration capable of carrying out the operations described herein.

FIG. 10A is a schematic illustration of a control circuit 110 with at least one controller 110*c* that directs the operation of the vacuum system for maintaining a substantially constant background pressure P1, P2 in each chamber using data from pressure sensors 66 and control signals to control valves for at least one pump, shown as with pump 85 and valve 85*v*, with pump 80 and valve 80*v* shown in broken line to indicate optional features. The control circuit 110 can also control leak valve 88*v* (FIGS. 1B, 1D) and/or inlet (needle) valve 83*v* (FIG. 2), or other pressure control devices. FIG. 10A also illustrates a divergent shaped flow path 20P.

Figure 10B:
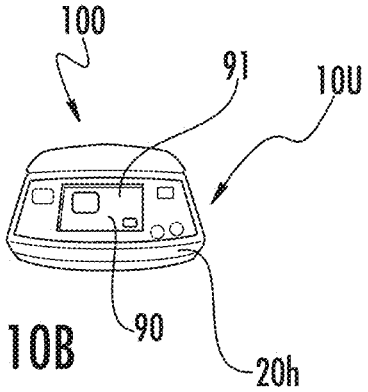
FIG. 10B is a top perspective view of a portable, hand-held mass spectrometer according to embodiments of the present invention.

As shown in FIG. 10B, the housing 20*h* can reside in a portable, light-weight mass spectrometer unit 10U with a display 90 and User Interface 91. The term "light weight" means between about 1 to about 15 pounds, more typically between about 1-10 pounds, such as about 3 pounds, about 4 pounds, about 5 pounds, about 6 pounds, about 7 pounds, about 8 pounds, about 9 pounds and about 10 pounds, with onboard vacuum pump/pumps and without the pressurized buffer gas source if something other than air is used.

Embodiments of the invention will be described further with respect to the non-limiting examples provided below.

EXAMPLES

Introduction

Miniature cylindrical ion traps (CIT) at pressures of ≈1 Torr were chosen for reduction to practice examples of some embodiments of the present invention. Significant reduction in size, weight, and, power (SWaP) results from the diminished pumping requirements of high-pressure operation. Standard electron multiplier detectors cannot be utilized at high pressures. Dual differentially pumped chambers were used to simultaneously achieve reduced pumping requirements and high detector sensitivity. In these configurations, the ionizer/trap and detector are held at two different pressures. One result of differential pumping is gas flow through the CIT mounted on the partition between the chambers. Simulations and experimental studies of the impact of buffer gas flow on mass spectral performance are discussed below.

Experimental Setup

During the experiment, the trap chamber was held at a constant pressure $P_1$ adjusted by a needle valve. A 10 liter Tedlar bag was connected to the Inlet filled with either $N_2$ or He and approximately 20 ppm mesitylene. Most of the gas load was by-passed to a roughing pump before entering the trap chamber.

The detector chamber was directly mounted to the entrance of a 80 l/s turbo pump through a shut off valve. The pressure in the detector chamber ($P_2$) could be controlled by reducing the conductance of the valve from fully open to fully closed position. Pressures were measured by a 275i KJLC convectron gauge (P1) and an Agilent FRG-700 gauge (P2).

Both gauges were calibrated to a 0.2% accuracy against an Inficon Capacitance Manometer (part number CDG025D) and pressure measurements were corrected. A 7-CIT array (traps dimensions $r_0$=0.5 mm, Ring thickness=0.79 mm, electrodes spacing=0.250 mm, End cap holes radius=0.200 mm) was used to maximize the signal intensity. A 7.11 MHz drive RF voltage was applied between the ring electrode and the end caps ramped from 184 $V_{0\text{-}p}$ (trapping voltage) to 406 $V_{0\text{-}p}$.

Results in Nitrogen (FIG. 11)

FIG. 11 shows a series of mass spectra taken with different pressure ratios between the ion source side ($P_1$) and detector side ($P_2$) of the ion trap. The lowest signal is obtained when the pressure on both sides of the trap are equivalent. A roughly 10% drop in $P_2$ results in the signal increasing by approximately a factor of 2. Further reductions in $P_2$ yield diminishing increases in the signal. Peaks of all masses appear to be uniformly affected. Peak widths remain nearly constant with the increasing pressure drop and corresponding increasing gas flow through the trap.

Results in Helium (FIG. 12)

A higher pressure of 1.77 Torr, required to ignite the plasma of the GD, was maintained on the trap side (the Pashen curve in He being shifted to higher P×dist. region with respect to $N_2$). Similar to the experiments using nitrogen buffer gas, the ion signal increases as the pressure ratio of $P_2/P_1$ is changed from unity to lesser values. The signal maximizes for relatively small differences in pressure as with nitrogen.

Figure 13A:
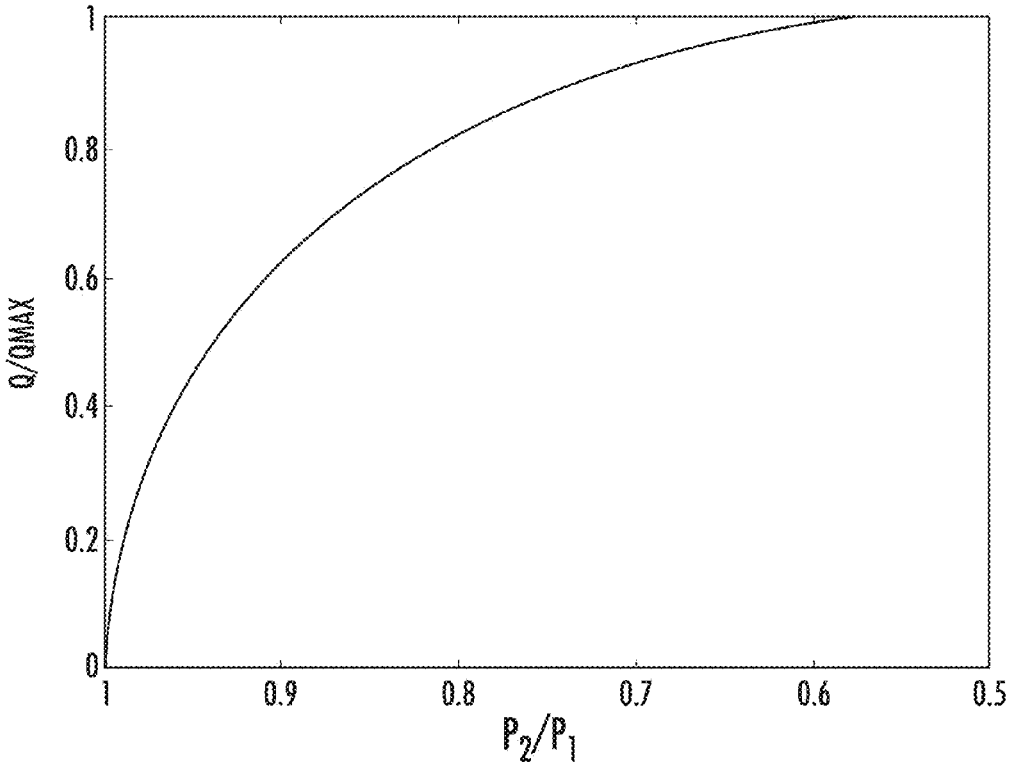
FIG. 13A is a graph of flow Q/Qmax through an exit end cap as a function of upstream and downstream pressure ratio P2/P1 according to embodiments of the present invention.
Figure 13B:
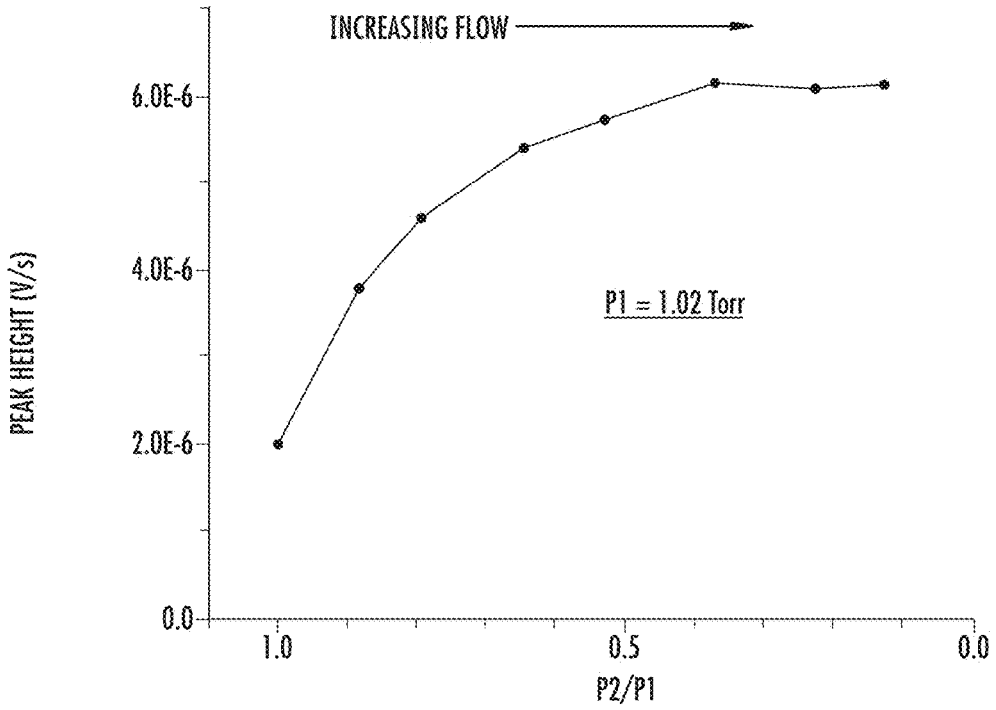
FIG. 13B is a graph of signal strength (peak height V/s of mass 105 Th of Mesitylene) vs. pressure ratio difference showing correspondence to mass flow through a trap predicted from theory in FIG. 13A according to embodiments of the present invention.

Gas Throughput (FIG. 13A)

FIG. 13A shows a plot of the expected relative gas throughput (mass per unit time) conducted through an aperture versus the relative pressures on either side of the aperture. $P_2$ is the low-pressure side and $P_1$ the high-pressure side of the aperture. It can be seen that the gas throughput reaches an asymptotic limit at relatively low pressure ratios. While not wishing to be bound by any particular theory, based on one theory of operation, this condition is termed "choked flow." It is possible that flow through the trap exit apertures(s) becomes maximum when the critical downstream pressure, $P_2$*, is reached, potentially according to Equation 2 below, where $P_1$ is the high pressure side of the trap electrodes as described above and γ has a value of 1.4 for diatomic buffer gases and 1.66 for monoatomic buffer gases. Equation 2 yields a critical pressure ratio values of 0.53 and 0.49 for diatomic and monoatomic gases respectively.

$$\frac{P_2^*}{P_1} = \left(\frac{2}{\gamma+1}\right)^{\frac{\gamma}{\gamma-1}} \qquad \text{Equation 2}$$

(ref. A. Chambers, 2005, *Modern Vacuum Physics*, Chapman and Hall/CRC, Boca Rotan, USA, the contents of which are hereby incorporated by reference as if recited in full herein). However, some simulations of flow with P1 at about 1 Torr (transition flow regime) have shown characteristic choked flow at lower ratios (P2/P1 of about 0.1 or even 0.05) with pressure differentials 1 Torr (P1) to 0.1 Torr (P2) and Equation 2 may not accurately reflect these critical pressure ratios.

FIG. 13B is a graph that illustrates ion signal strength vs. pressure difference for the nitrogen experiment discussed above. The ion signal variation with pressure is in correspondence with the gas throughput conducted through the trap apertures predicted from theory in FIG. 13A. While not wishing to be bound by any one theory, it is possible that the buffer gas flowing through the ring electrode of the trap is sufficient to push the trapped ion cloud away from the physical center of the trap electrodes toward the detector endcap. Ions in this position may be preferentially ejected through the endcap adjacent to the detector rather than equally through both endcaps. Alternatively, according to another theory and some simulations using Direct Simulation Monte Carlo for the flow computations, ion cloud position may not be effected up to very high flow conditions (1 Torr/0.1 Torr). Rather, it is believed that a more predominant effect may be due to a reduction of pressure inside the trap electrode structure caused by the acceleration of gas within the trap. See, e.g., FIGS. 14A-14C. These plots compare mass spectra obtained with flow to mass spectra without flow obtained at pressures equal to reduced pressures inside the trap. Comparable ion enhancement is obtained. Also, FIG. 14C indicates the values of the median pressures for every pressures conditions, illustrative of the conversion of pressure into gas flow kinetic energy.

Once choked flow conditions are reached across the exit endcap aperture, any further decrease of the downstream pressure cannot be communicated upstream. Thus, no change in mass flow rate through the trap or pressure within the trap will occur if the downstream pressure is decreased below the critical pressure and the ion signal will not further increase.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed:

1. A mass spectrometer (HPMS), comprising:

at least one mass analyzer ion trap comprising an injector endcap electrode, a ring electrode and an ejector endcap electrode;

a first chamber comprising an ion source and the ion trap mass analyzer at a common first background pressure P1;

a second chamber comprising a detector in direct fluid communication with and downstream, but adjacent, the first chamber;

at least one vacuum pump in communication with at least one of the first and second chambers;

a valve positioned between the first and second chambers;

at least one pressure sensor positioned in at least one of the first and second chambers; and a controller connected to the at least one pressure sensor, the valve, and the at least one vacuum pump and configured so that during operation of the HPMS, the controller:

receives pressure information for at least one of the first and second chambers from the at least one pressure sensor; and activates the at least one vacuum pump and the valve to maintain the first background pressure P1 of between 0.01 Torr and 1000 Torr in the first chamber, and a second background pressure P2 less than P1 in the second chamber, wherein a ratio of P2/P1 is less than 1 and greater than about 0.1; and wherein the ratio P2/P1 generates an increase in peak height in at least one detected ion signal of at least 30% measured using a test sample of mesitylene, the at least one detected ion signal being associated with an ion of the test sample, relative to a corresponding ion signal measured when P1=P2.

2. The HPMS of claim 1, wherein during operation of the HPMS, the mass analyzer ion trap and pressure ratio P2/P1 generate a convective flow of buffer gas with a Knudsen value (Kn) less than 10 to thereby generate gas flow in a viscous or transition regime.

3. The HPMS of claim 1, wherein P1/P2 is selected to generate a detected ion signal with a peak height of ion intensity of an ion in a sample under analysis that is increased from a corresponding baseline peak intensity value obtained when P2=P1 by between 30% to about 200%, measured with respect to an ion or ions associated with the mesitylene test sample.

4. The HPMS of claim 1, wherein P2/P1 is one of: 0.90, 0.85, 0.80, 0.75, 0.70, 0.65, 0.60, 0.55, 0.50, 0.45, 0.40, 0.35, 0.30, 0.25, 0.20, 0.15, and 0.10.

5. The HPMS of claim 1, wherein P1 is at or above 100 mTorr.

6. The HPMS of claim 1, wherein only an outer perimeter portion of the ring electrode is sealably attached to a corresponding outer perimeter portion of the ejector and/or the injector endcap electrode to define an open sealed space therebetween to thereby block incoming buffer gas.

7. The HPMS of claim 1, further comprising a buffer and sample gas inlet that is in fluid communication with the first chamber and allows a sample and buffer gas to enter the first chamber.

8. The HPMS of claim 1, wherein the injector endcap electrode and the ejector endcap electrode are both sealably attached to the ring electrode to define a respective sealed space therebetween whereby incoming buffer gas is primarily only allowed through one or more apertures extending axially through the injector endcap electrode.

9. The HPMS of claim 1, further comprising a solid, gas-impermeable wall or partition separating the first and second chambers, with the ion trap directly or indirectly sealably attached thereto, the internal wall or partition having at least one axially extending flow path channel aligned with the ejector endcap aperture or apertures to direct a mass flux of buffer gas to the second chamber.

10. A high-pressure mass spectrometer (HPMS), comprising:

at least one mass analyzer ion trap comprising an injector endcap electrode, a ring electrode and an ejector endcap electrode, wherein at least a perimeter portion of the ring electrode is sealably attached to a corresponding perimeter portion of the injector electrode and/or the ejector electrode to define a sealed space therebetween to thereby block incoming buffer gas;

a first chamber or sub-chamber comprising an ion source and the ion trap mass analyzer at a common first background pressure P1;

a second chamber or sub-chamber comprising a detector in direct fluid communication with and downstream, but adjacent, the first chamber or sub-chamber;

a pump in communication with at least one of the first chamber or sub-chamber and the second chamber or sub-chamber;

a valve positioned between the first chamber or sub-chamber and the second chamber or sub-chamber;

a controller connected to the pump and the valve and configured so that during operation of the HPMS, the controller activates the pump and the valve to maintain the first background pressure P1 greater than 0.01 Torr in the first chamber or sub-chamber, and to maintain a second background pressure P2 less than P1 in the second chamber or sub-chamber.

11. The HPMS of claim 10, wherein a ratio of P2/P1 is less than 1 and greater than 0.1, and wherein during operation of the HPMS, the mass analyzer and pressure ratio P2/P1 generate a convective flow of buffer gas with a Knudsen value (Kn) less than 10 to thereby generate gas flow in a viscous regime.

12. The HPMS of claim 10, wherein a partial radial extent of inner surfaces of the injector endcap electrode and the ejector endcap electrode are both sealably attached to the ring electrode to define a respective sealed open space therebetween whereby incoming buffer gas is primarily allowed through one or more apertures extending axially through the injector endcap electrode.

13. The HPMS of claim 10, wherein the sealed space of the ring and endcap electrode has a leak rate of no more than 10% of an average gas flow rate through the mass analyzer ion trap.

14. The HPMS of claim 10, wherein P2/P1 is selected to generate an increase in peak height in at least one detected ion signal of at least 30% relative to when the first and second chambers or sub-chambers are operated at a common pressure, with the at least one detected ion signal associated with an ion of the a sample.

15. The HPMS of claim 10, wherein P2 is above 500 mTorr, and wherein P1 is between 1 Torr and 10 Torr.

16. The HPMS of claim 10, further comprising a gas impermeable, electrically insulating sealant that surrounds an axially extending ring electrode through-aperture or apertures, residing between the ring electrode and the ejector endcap electrode and/or residing between the injector endcap electrode and the ring electrode to provide the sealed attachment.

17. The HPMS of claim 10, further comprising:

a mounting fixture holding the ion trap, the mounting fixture having a planar surface that either (a) has an axially extending open channel and resides downstream of the ion trap, the planar surface abutting an inwardly extending ledge of a housing holding the first and/or second chamber or sub-chamber or (b) resides upstream of the ion trap and holds the ion trap against a wall or partition separating the first and second chambers or sub-chambers; and at least one coaxial feed through extending through an outer wall of a HPMS housing to at least one of the first and second chamber or sub-chambers.

18. The HPMS of claim 10, further comprising a solid, gas-impermeable wall or partition separating the first and second chambers or sub-chambers, with the ion trap directly or indirectly sealably attached thereto, the internal wall or partition having at least one axially extending flow path channel aligned with the ejector endcap aperture or apertures to direct mass flux buffer gas to the detector.

19. The HPMS of claim 10, further comprising:

a housing, wherein the first chamber or sub-chamber is a first chamber and the second chamber or sub-chamber is a second chamber positioned adjacent the first chamber, and wherein the first and second chambers are positioned within the housing;

wherein the mass analyzer ion trap is closely spaced apart from the detector to reside within a distance of between about 1 mm to about 10 mm thereof, and wherein the mass analyzer ion trap is either:

(a) a CIT with critical dimensions $r_0$ or $z_0$ less than about 1 mm; or (b) a Stretched Length Ion Trap (SLIT) with the ring electrode having an aperture which extends along a longitudinal direction and the central electrode surrounds the aperture in a lateral plane perpendicular to the longitudinal direction to define a transverse cavity for trapping charged particles, wherein the aperture in the ring electrode is elongated in the lateral plane optionally having a ratio of a major dimension to a minor dimension that is greater than 1.5.

20. The HPMS of claim 10, wherein the pressure P1 is between 1 Torr and 10 Torr, wherein P1/P2 is selected to generate peak heights of ion intensity of a respective ion in a sample under analysis that are increased from baseline peak intensity value obtained when P2=P1 by between about 30% to about 200%, measured using an ion associated with a test sample comprising mesitylen.

21. The HPMS of claim 10, further comprising a buffer gas and sample inlet in fluid communication with the first chamber, wherein the first chamber or sub-chamber is a first chamber and the second chamber or sub-chamber is a second chamber positioned adjacent the first chamber.

22. A mass spectrometer (HPMS), comprising:

at least one mass analyzer ion trap comprising an injector endcap electrode, a ring electrode and an ejector endcap electrode;

a first chamber or sub-chamber comprising an ion source and the mass analyzer ion trap at a common first background pressure P1;

a second chamber or sub-chamber comprising a detector in direct fluid communication with and downstream, but adjacent, the first chamber;

at least one vacuum pump in communication with the first and/or second chambers or sub-chambers a valve positioned between the first chamber or sub-chamber and the second chamber or sub-chamber; and a controller connected to the valve and to the at least one vacuum pump and configured so that during operation of the HPMS, the controller activates the at least one vacuum pump and the valve to maintain the first background pressure P1 of between about 0.1 Torr and 1000 Torr in the first chamber or sub-chamber, and to maintain a second background pressure P2 less than P1 in the second chamber or sub-chamber, wherein a ratio of P2/P1 is between about 0.9 and about 0.1.

23. The HPMS of claim 22, wherein P2/P1 is between about 0.9 and about 0.5, and wherein during operation of the HPMS, a peak height of at least one detected ion signal increases by at least 30% relative to when the first and second chambers or sub-chambers are operated at a common pressure where P1=P2, measured using an ion associated with a test sample comprising mesitylene.

24. A high-pressure mass spectrometer (HPMS), comprising:

a housing;

a first chamber or sub-chamber held by the housing having at least one sample and/or buffer gas inlet port;

at least one mass analyzer ion trap comprising an injector endcap electrode, a ring electrode and an ejector endcap electrode held in the first chamber or sub-chamber;

an ionizer in the first chamber or sub-chamber with the at least one mass analyzer ion trap at a common first background pressure P1;

a second chamber or sub-chamber held by the housing comprising a detector in direct fluid communication with and downstream, but adjacent, the first chamber or sub-chamber;

at least one vacuum pump in communication with the first and second chambers or sub-chambers;

a valve positioned between the first chamber or sub-chamber and the second chamber or sub-chamber; and a controller connected to the at least one vacuum pump and the valve and configured so that during operation of the HPMS, the controller activates the at least one vacuum pump and the valve to maintain the first background pressure P1 of between 0.1 Torr and 10 Torr in the first chamber or sub-chamber, and to maintain a second background pressure P2 less than P1 in the second chamber or sub-chamber, wherein a ratio of P2/P1 is less than 1 and greater than about 0.1; and wherein a value of P2/P1 is selected to generate an increase in peak height in at least one detected ion signal of at least 30% relative to when the first and second chambers or sub-chambers are operated at a common pressure where P1=P2, measured using an ion associated with a test sample of mesitylene.

25. The HPMS of claim 24, wherein only an outer perimeter portion of the ring electrode is sealably attached to a corresponding outer perimeter portion of at least one of the injector endcap electrode or ejector endcap electrode to define an open sealed space therebetween to thereby block incoming buffer gas.

26. The HPMS of claim 24, wherein the at least one vacuum pump is a single vacuum pump attached to a vacuum port in the second chamber or sub-chamber.

27. The HPMS of claim 22, wherein the ejector and injector endcap electrodes are axially spaced apart from the ring electrode with an open gap space extending about a radial extent between an outer perimeter and portion of the ejector and injector electrodes and an outer perimeter portion of the ring electrode to an inner perimeter of the ring electrode and the ejector and injector endcap electrodes.

* * * * *